US007927774B2

(12) United States Patent
Ogaki et al.

(10) Patent No.: US 7,927,774 B2
(45) Date of Patent: Apr. 19, 2011

(54) ELECTROPHOTOGRAPHIC PHOTOSENSITIVE MEMBER, PROCESS CARTRIDGE AND ELECTROPHOTOGRAPHIC APPARATUS

(75) Inventors: Harunobu Ogaki, Suntoh-gun (JP); Takakazu Tanaka, Numasu (JP); Kenichi Kaku, Suntoh-gun (JP); Akira Yoshida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/555,487

(22) Filed: Sep. 8, 2009

(65) Prior Publication Data

US 2009/0324282 A1 Dec. 31, 2009

Related U.S. Application Data

(63) Continuation of application No. 11/572,698, filed as application No. PCT/JP2005/016681 on Sep. 5, 2005, now Pat. No. 7,585,604.

(30) Foreign Application Priority Data

Sep. 10, 2004 (JP) ..... 2004/264221

(51) Int. Cl.
*G03G 5/00* (2006.01)

(52) U.S. Cl. ..... 430/59.1; 430/59.6; 430/96; 430/66

(58) Field of Classification Search ..... 430/59.1, 430/59.6, 96, 66; 399/159
See application file for complete search history.

(56) References Cited

U.S. PATENT DOCUMENTS

| | | | | |
|---|---|---|---|---|
| 4,840,861 | A | 6/1989 | Staudenmayer et al. | 430/59 |
| 5,162,485 | A | 11/1992 | Odell et al. | 528/194 |
| 6,174,635 | B1 | 1/2001 | Terrell et al. | 430/56 |
| 7,585,604 | B2 * | 9/2009 | Ogaki et al. | 430/59.1 |

FOREIGN PATENT DOCUMENTS

| | | |
|---|---|---|
| JP | 02-127654 | 5/1990 |
| JP | 03-139722 | 6/1991 |
| JP | 06-035215 | 2/1994 |
| JP | 09-240051 | 9/1997 |
| JP | 10-039521 | 2/1998 |
| JP | 11-174698 | 7/1999 |
| JP | 2000-105471 | 4/2000 |
| JP | 2001-100442 | 4/2001 |
| JP | 2002-023393 | 1/2002 |
| JP | 2002-265575 | 9/2002 |
| JP | 2003-057926 | 2/2003 |
| JP | 2004-093866 | 3/2004 |

OTHER PUBLICATIONS

Japanese Office Action dated Aug. 19, 2009 counterpart application No. 2005-259460 (English-language translation)—11 pages.

* cited by examiner

*Primary Examiner* — Mark A Chapman
(74) *Attorney, Agent, or Firm* — Fitzpatrick, Cella, Harper & Scinto

(57) ABSTRACT

An object of the present invention is to provide an electrophotographic photosensitive member having high durability and hardly causing sensitivity decrease even if short wavelength light, particularly light having a wavelength of 380 to 450 nm is used as exposure light, and a process cartridge and an electrophotographic apparatus having the electrophotographic photosensitive member. The present invention includes an electrophotographic photosensitive member comprising a support and a photosensitive layer which is provided on the support and contains a charge generation material and a charge transport material, characterized in that the surface layer of the electrophotographic photosensitive member contains an aliphatic dicarboxylic acid polyester resin with a weight average molecular weight of 80,000 or more having a specific repeating structural unit, and a process cartridge and an electrophotographic apparatus having the electrophotographic photosensitive member.

2 Claims, 2 Drawing Sheets

ELECTROPHOTOGRAPHIC PHOTOSENSITIVE MEMBER, PROCESS CARTRIDGE AND ELECTROPHOTOGRAPHIC APPARATUS

This application is a Continuation of application Ser. No. 11/572,698, filed Jan. 25, 2007 now U.S. Pat. No. 7,585,604 B2, which, in turn, is a national phase under 35 U.S.C. §371 of International Application No. PCT/JP2005/016681, filed Sep. 5, 2005 which is incorporated by reference herein.

TECHNICAL FIELD

The present invention relates to an electrophotographic photosensitive member, and a process cartridge and an electrophotographic apparatus which have the electrophotographic photosensitive member.

BACKGROUND ART

Photoconductive materials (charge generation materials and charge transport materials) used for an electrophotographic photosensitive member installed in an electrophotographic apparatus include inorganic photoconductive materials such as selenium, cadmium sulfide and zinc oxide. Recently, however, from the viewpoint of no pollution, high productivity and ease in material design, organic photoconductive materials have been actively developed.

An electrophotographic photosensitive member using an organic photoconductive material (organic electrophotographic photosensitive member) generally has a photosensitive layer formed by applying, on a support, a coating solution obtained by dissolving and dispersing an organic photoconductive material and a binder resin in a solvent and drying the same. Regarding the layer structure of the photosensitive layer, a multi-layer type (regular-layer type) photosensitive layer in which a charge generation layer and a charge transport layer are stacked in that order from the support side is common.

Although electrophotographic photosensitive members using an organic photoconductive material have the above-described advantages, not all properties that electrophotographic photosensitive members are required to possess have been highly satisfied, and further improvement in quality of output images and durability of the electrophotographic photosensitive members are desired.

For improvement in image qualities, in order to further increase the resolution of output images, use of light having a wavelength shorter than conventionally used light as exposure light (image exposure light) for irradiating an electrophotographic photosensitive member has been recently proposed (Japanese Patent Application Laid-Open No. H09-240051, etc.).

In addition, from the fact that transmittance of layers against exposure light influences the sensitivity of an electrophotographic photosensitive member, Japanese Patent Application Laid-Open No. 2000-105471, for example, discloses a technique of forming a charge transport layer of a multi-layer type (regular-layer type) photosensitive layer into a layer having a high transmittance against short wavelength exposure light. More specifically, by using a compound having a specific structure as a charge transport material and polycarbonate resin (bisphenol Z polycarbonate) as a binder resin, a charge transport layer having a high transmittance against short wavelength exposure light is formed.

On the other hand, for improving durability, polycarbonate resins have been commonly used as a binder resin for the surface layer of an electrophotographic photosensitive member. Recently, however, it has been proposed to further improve durability of electrophotographic photosensitive members by using a polyarylate resin which has a higher mechanical strength than polycarbonate resin as a binder resin for the surface layer (Japanese Patent Application Laid-Open No. H10-039521, etc.). Polyarylate resins are examples of aromatic dicarboxylic acid polyester resins.

DISCLOSURE OF THE INVENTION

However, although polyarylate resins disclosed in Japanese Patent Application Laid-Open No. H10-039521 have high mechanical strength and a high durability electrophotographic photosensitive member can be formed when the resin is used for the surface layer of the electrophotographic photosensitive member, the layer using the polyarylate resin has a relatively low transmittance against light of short wavelength, particularly light having a wavelength of 380 to 450 nm, and in some cases, the sensitivity of the electrophotographic photosensitive member is decreased.

On the other hand, regarding the electrophotographic photosensitive member disclosed in detail in Japanese Patent Application Laid-Open No. 2000-105471, the surface layer (charge transport layer) thereof has a high transmittance against short wavelength light, and hardly causes decrease in the sensitivity when short wavelength light is used as exposure light for high image quality. However, because a polycarbonate resin which is inferior in mechanical strength to a polyarylate resin is used as a binder resin of the surface layer, it cannot be said that the durability is sufficient.

An object of the present invention is to provide an electrophotographic photosensitive member having high durability and hardly causing sensitivity decrease even if short wavelength light, particularly light having a wavelength of 380 to 450 nm is used as exposure light, and a process cartridge and an electrophotographic apparatus, both containing the electrophotographic photosensitive member.

The present invention provides an electrophotographic photosensitive member comprising a support and a photosensitive layer which is provided on the support and contains a charge generation material and a charge transport material, characterized in that the surface layer of the electrophotographic photosensitive member contains an aliphatic dicarboxylic acid polyester resin with a weight average molecular weight of 80,000 or more having a repeating structural unit represented by the following formula (1):

(1)

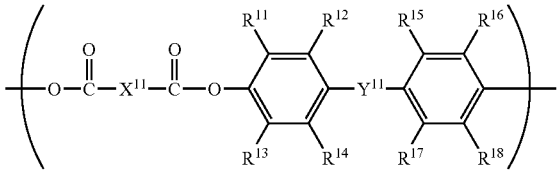

wherein $R^{11}$ to $R^{18}$ are each independently a hydrogen atom, an alkyl group, an alkoxy group or an aryl group, $X^{11}$ is a substituted or unsubstituted alkylene group having 3 to 10 carbon atoms in the main chain, a substituted or unsubstituted cycloalkylene group having 5 to 10 carbon atoms in the ring or a substituted or unsubstituted bicycloalkylene group having 5 to 10 carbon atoms in the ring, and $Y^{11}$ is a single bond, a Group 16 element or a divalent group having a structure represented by the following formula (2):

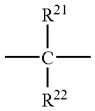

(2)

wherein $R^{21}$ and $R^{22}$ are each independently a hydrogen atom, an alkyl group, a fluoroalkyl group, an alkoxy group or an aryl group, or $R^{21}$ and $R^{22}$ are bonded together to form a cycloalkylidene group or a fluorenylidene group.

The present invention also provides a process cartridge and an electrophotographic apparatus having the above-described electrophotographic photosensitive member.

The present invention can provide an electrophotographic photosensitive member having high durability and hardly causing sensitivity decrease even if short wavelength light, particularly light having a wavelength of 380 to 450 nm is used as exposure light, and a process cartridge and an electrophotographic apparatus having the electrophotographic photosensitive member.

BEST MODE FOR CARRYING OUT THE INVENTION

Figure 1A:
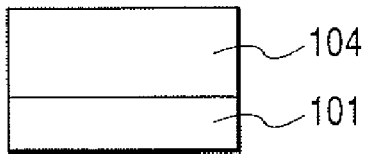
FIGS. 1A, 1B, 1C and 1D illustrate examples of layer structures of the electrophotographic photosensitive member of the present invention.

As described above, the electrophotographic photosensitive member of the present invention contains, in the surface layer, an aliphatic dicarboxylic acid polyester resin with a weight average molecular weight of 80,000 or more having a repeating structural unit represented by the following formula (1):

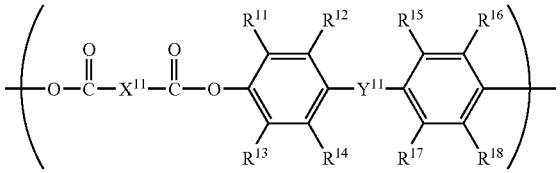

(1)

In the above formula (1), $R^{11}$ to $R^{18}$ are each independently a hydrogen atom, an alkyl group, an alkoxy group or an aryl group, $X^{11}$ is a substituted or unsubstituted alkylene group having 3 to 10 carbon atoms in the main chain, a substituted or unsubstituted cycloalkylene group having 5 to 10 carbon atoms in the ring or a substituted or unsubstituted bicycloalkylene group having 5 to 10 carbon atoms in the ring, and $Y^{11}$ is a single bond, a Group 16 element or a divalent group having a structure represented by the following formula (2):

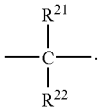

(2)

In the above formula (2), $R^{21}$ and $R^{22}$ are each independently a hydrogen atom, an alkyl group, a fluoroalkyl group, an alkoxy group or an aryl group, or $R^{21}$ and $R^{22}$ are bonded together to form a cycloalkylidene group or a fluorenylidene group.

Examples of alkyl groups represented by $R^{11}$ to $R^{18}$ in the above formula (1) include a methyl group, an ethyl group, a propyl group and a butyl group. Examples of alkoxy groups include a methoxy group, an ethoxy group, a propoxy group and a butoxy group. Examples of aryl groups include a phenyl group and a naphthyl group. Of these, a methyl group, an ethyl group, a methoxy group, an ethoxy group and a phenyl group are preferred.

Examples of substituted or unsubstituted alkylene groups having 3 to 10 carbon atoms in the main chain represented by $X^{11}$ in the above formula (1) include a substituted or unsubstituted propylene group, a substituted or unsubstituted butylene group, a substituted or unsubstituted pentylene group, a substituted or unsubstituted hexylene group, a substituted or unsubstituted heptylene group, a substituted or unsubstituted octylene group, a substituted or unsubstituted nonylene group and a substituted or unsubstituted decylene group. Of these, a substituted or unsubstituted butylene group, a substituted or unsubstituted pentylene group, a substituted or unsubstituted hexylene group, a substituted or unsubstituted heptylene group and a substituted or unsubstituted octylene group are preferred.

Examples of substituted or unsubstituted cycloalkylene groups having 5 to 10 carbon atoms in the ring represented by $X^{11}$ in the above formula (1) include a substituted or unsubstituted cyclopentylene group, a substituted or unsubstituted cyclohexylene group, a substituted or unsubstituted cycloheptylene group, a substituted or unsubstituted cyclooctylene group, a substituted or unsubstituted cyclononylene group and a substituted or unsubstituted cyclodecylene group. Of these, a substituted or unsubstituted cyclohexylene group is preferred.

Examples of substituted or unsubstituted bicycloalkylene groups having 5 to 10 carbon atoms in the ring represented by $X^{11}$ in the above formula (1) include a substituted or unsubstituted bicyclopentylene group, a substituted or unsubstituted bicyclohexylene group, a substituted or unsubstituted bicycloheptylene group, a substituted or unsubstituted bicyclooctylene group, a substituted or unsubstituted bicyclononylene group and a substituted or unsubstituted bicyclodecylene group. Of these, a substituted or unsubstituted bicyclodecylene group is preferred, and a 2,5-bicyclo[4.4.0] decylene group is more preferred.

The alkylene group, cycloalkylene group and bicycloalkylene group described above may contain a substituent including an alkyl group such as a methyl group, an ethyl group, a propyl group or a butyl group, a fluoroalkyl group such as a trifluoromethyl group and a pentafluoroethyl group, and an alkoxy group such as a methoxy group, an ethoxy group, a propoxy group and a butoxy group. Of these, a methyl group and a trifluoromethyl group are preferred. In addition, an unsubstituted alkylene group, an unsubstituted cycloalkylene group and an unsubstituted bicycloalkylene group are preferred.

The Group 16 element represented by $Y^{11}$ in the above formula (1) is preferably an oxygen atom or a sulfur atom.

Examples of alkyl groups represented by $R^{21}$ and $R^{22}$ in the above formula (2) include a methyl group, an ethyl group, a propyl group and a butyl group. Examples of fluoroalkyl groups include a trifluoromethyl group and a pentafluoroethyl group. Examples of alkoxy groups include a methoxy group, an ethoxy group, a propoxy group and a butoxy group. Examples of aryl groups include a phenyl group and a naphthyl group. Of these, a methyl group, an ethyl group, a propyl group (particularly isopropyl group), a trifluoromethyl group and a pentafluoroethylene group are preferred.

Examples of cycloalkylidene groups formed from $R^{21}$ and $R^{22}$ in the above formula (2) bonded together include a cyclopentylidene group, a cyclohexylidene group and a cycloheptylidene group. Of these, a cyclohexylidene group is preferred.

Of the repeating structural units represented by the above formula (1), preferred repeating structural units are as follows:

those in which at least one of $R^{11}$ to $R^{18}$ is an alkyl group, an alkoxy group or an aryl group, and $Y^{11}$ is a single bond;

those in which $Y^{11}$ is an oxygen atom or a sulfur atom;

those in which at least one of $R^{11}$ to $R^{18}$ is an alkyl group, an alkoxy group or an aryl group, $Y^{11}$ is a divalent group having a structure represented by the above formula (2), and $R^{21}$ and $R^{22}$ are each independently an alkyl group or a fluoroalkyl group; and those in which at least one of $R^{11}$ to $R^{18}$ is an alkyl group, an alkoxy group or an aryl group, $Y^{11}$ is a divalent group having a structure represented by the above formula (2) and $R^{21}$ and $R^{22}$ are bonded together to form a cyclohexylidene group.

In the following, specific examples of repeating structural units represented by the above formula (1) are described.

(1-1)

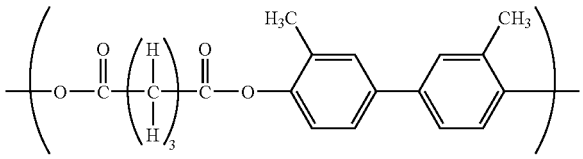

(1-2)

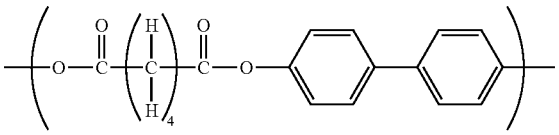

(1-3)

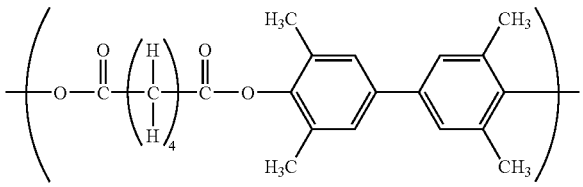

-continued (1-4)

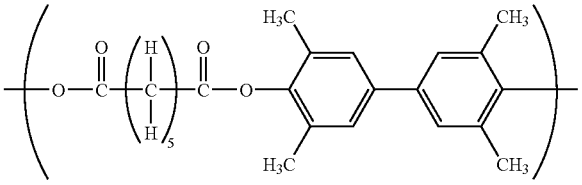

(1-5)

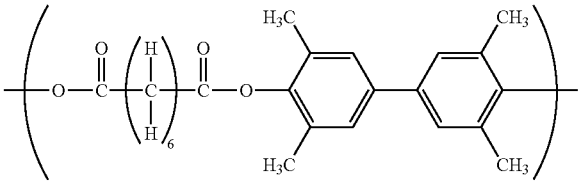

(1-6)

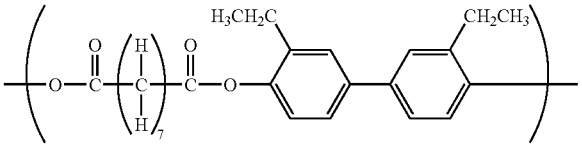

(1-7)

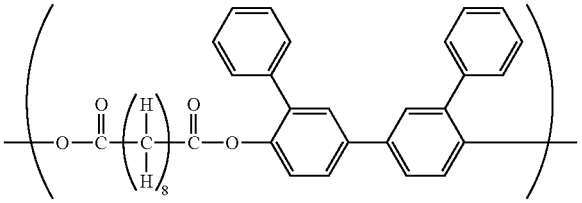

(1-8)

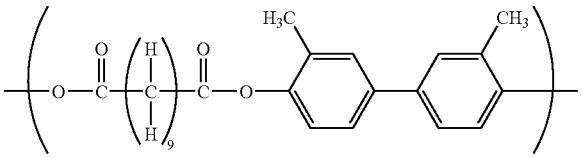

(1-9)

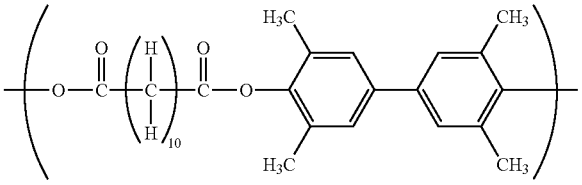

(1-10)

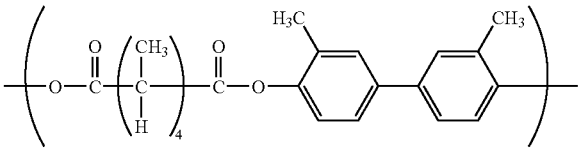

(1-11)

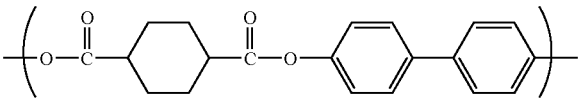

-continued
(1-12)
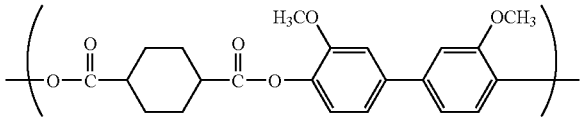
(1-13)
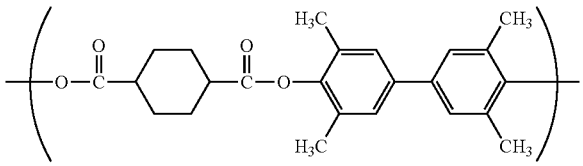
(1-14)
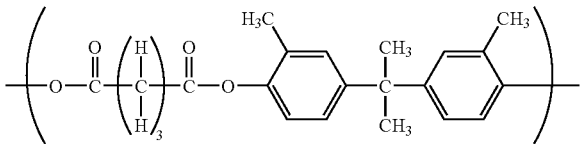
(1-15)
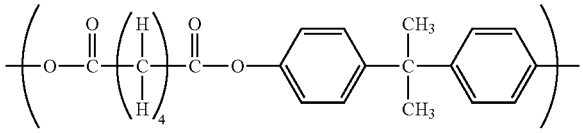
(1-16)
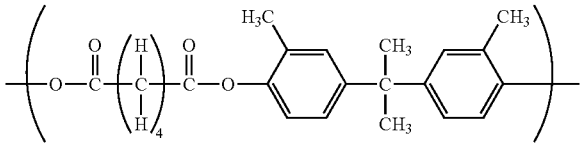
(1-17)
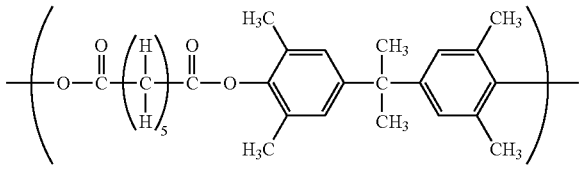
(1-18)
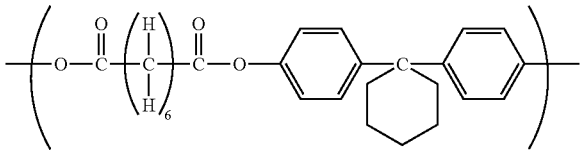
(1-19)
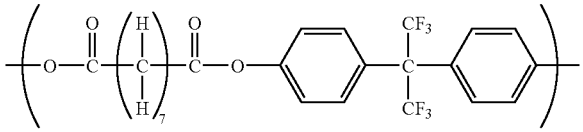
(1-20)
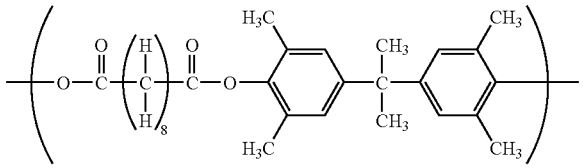
-continued
(1-21)
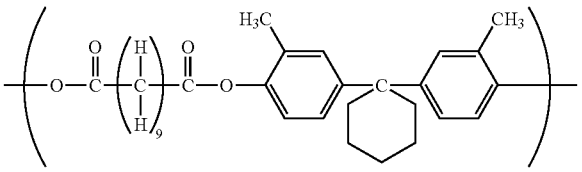
(1-22)
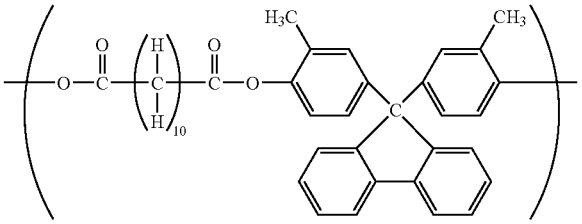
(1-23)
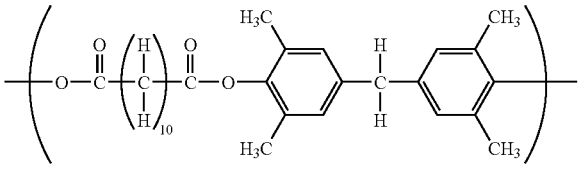
(1-24)
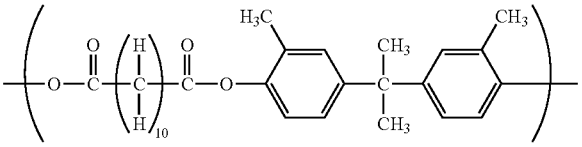
(1-25)
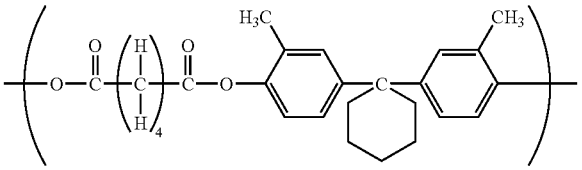
(1-26)
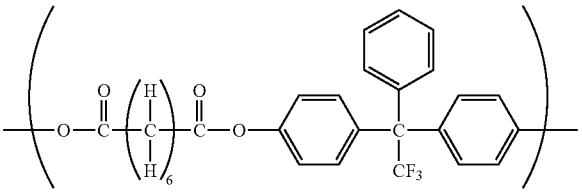
(1-27)
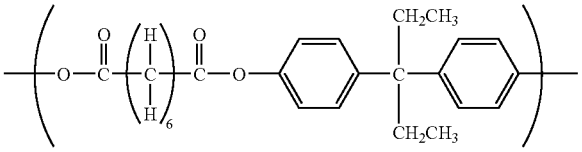
(1-28)
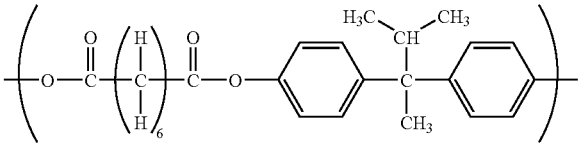

-continued
(1-29)
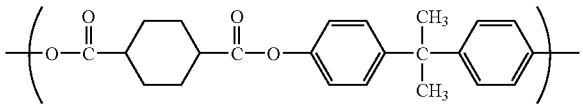
(1-30)
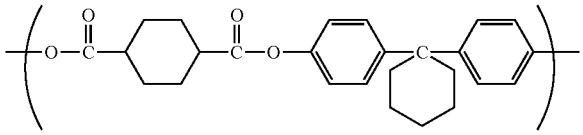
(1-31)
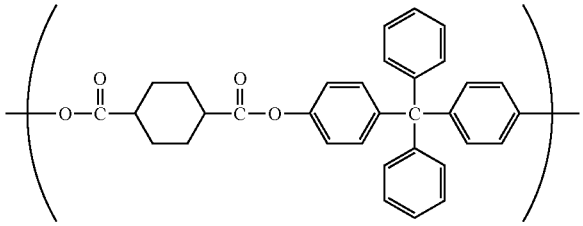
(1-32)
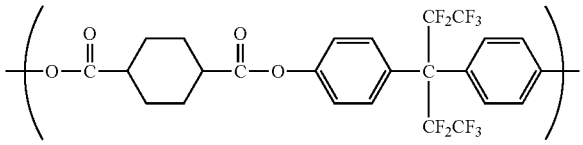
(1-33)
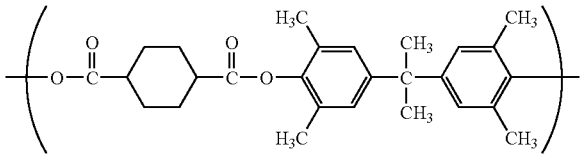
(1-34)
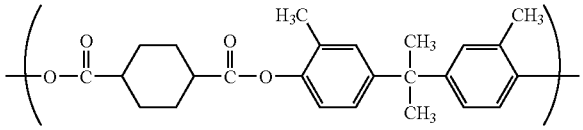
(1-35)
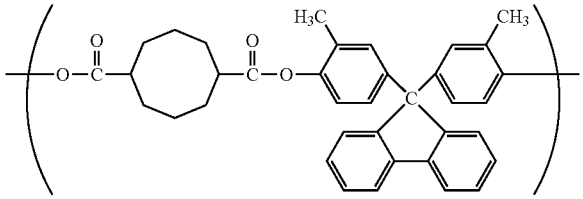
(1-36)
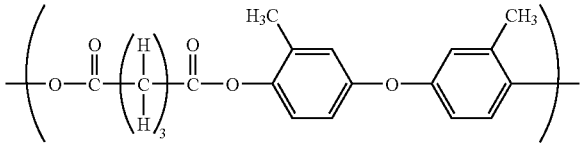
-continued
(1-37)
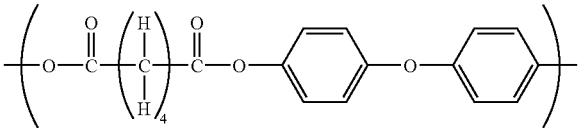
(1-38)
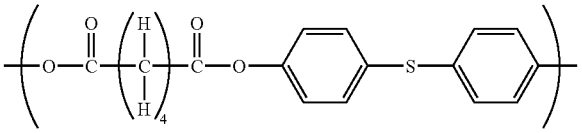
(1-39)
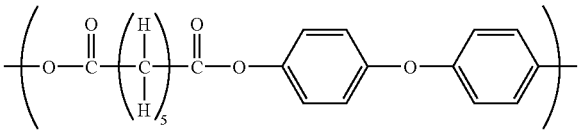
(1-40)
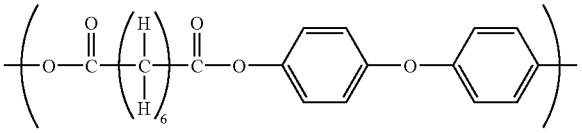
(1-41)
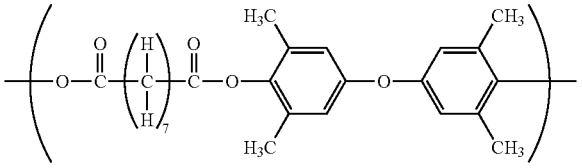
(1-42)
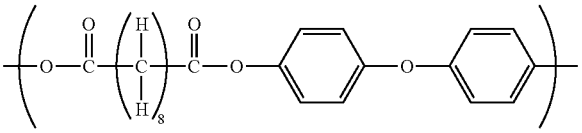
(1-43)
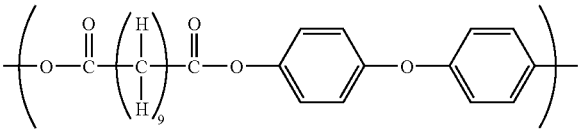
(1-44)
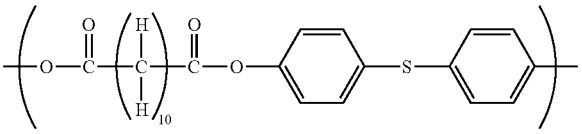
(1-45)
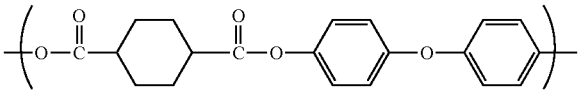

-continued (1-46)

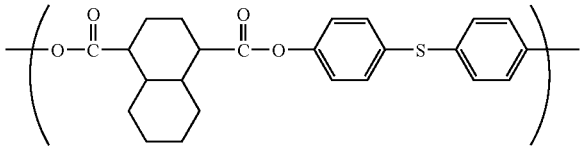

The aliphatic dicarboxylic acid polyester resin having a repeating structural unit represented by the above formula (1) used for the surface layer of the electrophotographic photosensitive member of the present invention has, as described earlier, a weight average molecular weight of 80,000 or more. Of the aliphatic dicarboxylic acid polyester resins having a repeating structural unit represented by the above formula (1), those having a weight average molecular weight of less than 80,000 have poor mechanical strength, and are insufficient for the improvement in the durability of the electrophotographic photosensitive member. The weight average molecular weight thereof is further preferably 90,000 or more.

On the other hand, when the molecular weight of the aliphatic dicarboxylic acid polyester resin having a repeating structural unit represented by the above formula (1) is too large, coatability of the coating solution containing the same may be reduced, and therefore the weight average molecular weight of the aliphatic dicarboxylic acid polyester resin having a repeating structural unit represented by the above formula (1) is preferably 400,000 or less, more preferably 300,000 or less.

The weight average molecular weight in the present invention is calculated in terms of polystyrene.

The aliphatic dicarboxylic acid polyester resin having a repeating structural unit represented by the above formula (1) used for the surface layer of the electrophotographic photosensitive member of the present invention can be synthesized by transesterification of dicarboxylic acid ester and a compound containing a hydroxyl group, or polymerization reaction between divalent acid halide such as dicarboxylic acid halide and a compound containing a hydroxyl group such as bisphenol. For producing resins with a weight average molecular weight of the above-described range, synthesis by the latter method is preferred.

Synthetic Example

A method of synthesizing an aliphatic dicarboxylic acid polyester resin having a repeating structural unit represented by the above formula (1-5) and having a weight average molecular weight of 80,000 or more is described below as a Synthetic Example.

Dicarboxylic acid halide (suberoyl chloride) having a structure represented by the following formula (1-5-1):

(1-5-1)

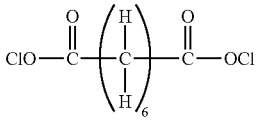

was dissolved in dichloromethane to prepare a suberoyl chloride solution.

Separately from the suberoyl chloride solution, bisphenol (tetramethylbiphenol) having a structure represented by the following formula (1-5-2):

(1-5-2)

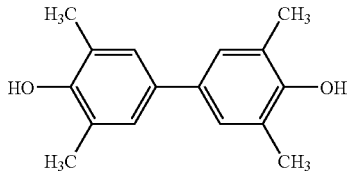

was dissolved in a 10% aqueous sodium hydroxide solution, and tributylbenzylammonium chloride was added thereto as a polymerization catalyst, and the mixture was stirred to prepare a tetramethylbiphenol solution.

Then, the suberoyl chloride solution was added to the tetramethylbiphenol solution with stirring to start polymerization. The polymerization was carried out with stirring at a constant reaction temperature of not higher than 25° C. for 3 hours.

The polymerization reaction was terminated by adding acetic acid, and washing with water was repeated until the aqueous phase was neutralized.

After washing, the resultant was added dropwise to methanol with stirring to precipitate polymerized product, which was vacuum dried to give an aliphatic dicarboxylic acid polyester resin having a repeating structural unit represented by the above formula (1-5). The aliphatic dicarboxylic acid polyester resin had a weight average molecular weight of 150,000.

In the present invention, the weight average molecular weight of the resin was measured in the following manner according to a usual method.

Specifically, a target resin is put in tetrahydrofuran and left for a few hours, and sufficiently mixed with tetrahydrofuran with stirring (until coalescent bodies of the target resin disappear). The mixture was allowed to stand for additional 12 hours.

The mixture was then passed through a sample treatment filter, Maishori Disk H-25-5 available from Tosoh Corporation, and the resultant was used as a GPC (gel permeation chromatography) sample.

Then, a column was stabilized in a heat chamber at 40° C., and tetrahydrofuran as a solvent was passed through the column at that temperature at a flow rate of 1 ml per minute. 10 μl of the GPC sample was then poured thereinto to measure the weight average molecular weight of the target resin. The column used was TSK gel Super HM-M available from Tosoh Corporation.

For measuring the weight average molecular weight of the target resin, the molecular weight distribution of the target resin was calculated based on the relationship between the log and the number counted in the calibration curves prepared using several types of monodisperse polystyrene standard samples. For the polystyrene standard samples for preparing the calibration curves, 10 monodisperse polystyrenes having a molecular weight of 800 to 2,000,000 available from SIGMA-ALDRICH CORPORATION were used, and an RI (refractive index) detector was used as a detector.

The structure of the electrophotographic photosensitive member of the present invention will now be described.

As described above, the electrophotographic photosensitive member of the present invention has a support and a photosensitive layer provided on the support.

The photosensitive layer may be a single layer type photosensitive layer containing a charge transport material and a charge generation material in one layer, or a multi-layer type (functionally separated) photosensitive layer comprising a charge generation layer containing a charge generation material and a charge transport layer containing a charge transport material. From the viewpoint of electrophotographic properties, multi-layer type photosensitive layers are preferred. Further, the multi-layer type photosensitive layers include regular-layer type photosensitive layers in which the charge generation layer and the charge transport layer are stacked in that order from the support side, and reverse-layer type photosensitive layers in which the charge transport layer and the charge generation layer are stacked in that order from the support side. From the viewpoint of electrophotographic properties, regular-layer type photosensitive layers are preferred. In addition, the charge generation layer may have a multi-layer structure, or the charge transport layer may have a multi-layer type structure.

A protective layer for protecting the photosensitive layer may be formed on the photosensitive layer.

FIGS. 1A, 1B, 1C and 1D show examples of layer structures of the electrophotographic photosensitive member of the present invention.

In the electrophotographic photosensitive member having a layer structure shown in FIG. 1A, a single layer type photosensitive layer 104 containing a charge generation material and a charge transport material is provided on a support 101. In the electrophotographic photosensitive member having a layer structure shown in FIG. 1A, the single photosensitive layer 104 constitutes the surface layer, and the single layer type photosensitive layer 104 contains an aliphatic dicarboxylic acid polyester resin with a weight average molecular weight of 80,000 or more having a repeating structural unit represented by the above formula (1).

Figure 1B:
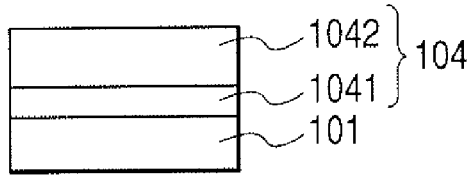

In the electrophotographic photosensitive member having a layer structure shown in FIG. 1B, a charge generation layer 1041 containing a charge generation material is provided on a support 101, and a charge transport layer 1042 containing a charge transport material is provided on the charge generation layer 1041. In other words, the photosensitive layer 104 of the electrophotographic photosensitive member having a layer structure shown in FIG. 1B is a multi-layer type (regular-layer type) photosensitive layer having the charge generation layer 1041 and the charge transport layer 1042. In the electrophotographic photosensitive member having a layer structure shown in FIG. 1B, the charge transport layer 1042 constitutes the surface layer, and the charge transport layer 1042 contains an aliphatic dicarboxylic acid polyester resin with a weight average molecular weight of 80,000 or more having a repeating structural unit represented by the above formula (1).

Figure 1C:
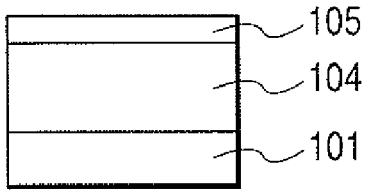
Figure 1D:
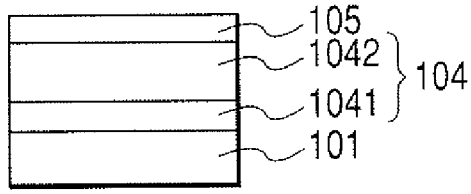

As shown in FIGS. 1C and 1D, a protective layer 105 may be formed on the photosensitive layer 104 as the surface layer of the electrophotographic photosensitive member. In the electrophotographic photosensitive members having a layer structure shown in FIGS. 1C and 1D, the protective layer 105 constitutes the surface layer, and the protective layer 105 contains an aliphatic dicarboxylic acid polyester resin with a weight average molecular weight of 80,000 or more having a repeating structural unit represented by the above formula (1).

Regardless of the layer structure, any other types are available as long as the surface layer of the electrophotographic photosensitive member, i.e., a layer disposed at the outermost surface of the electrophotographic photosensitive member, contains an aliphatic dicarboxylic acid polyester resin with a weight average molecular weight of 80,000 or more having a repeating structural unit represented by the above formula (1).

Regarding the support, those having conductivity (conductive support) may be used, and a support made of metal (or alloy) such as aluminum, aluminum alloy or stainless steel may be used. Alternatively, the above-described metal support or a plastic support which has a layer of aluminum, aluminum alloy or indium oxide-tin oxide alloy formed by vacuum deposition may also be used. Supports in which conductive particles such as carbon black, tin oxide particles, titanium oxide particles and silver particles are impregnated into plastic or paper together with an appropriate binder resin, or plastic supports containing a conductive binder resin may also be used. Further, the support may be cylindrical or in the form of a belt, and cylindrical supports are preferred.

The surface of the support may be subjected to cutting, roughening or an alumite treatment for preventing interference fringes due to scattering of laser beam.

A conductive layer may be formed between the support and the photosensitive layer (charge generation layer, charge transport layer) or an intermediate layer described later for preventing interference fringes due to scattering of laser beam or for covering scratches on the support.

The conductive layer may be formed by dispersing conductive particles such as carbon black, metal particles or metal oxide particles into a binder resin.

The conductive layer has a layer thickness of preferably 1 to 40 μm, more preferably 2 to 20 μm.

An intermediate layer having barrier function or adhesion function may be formed between the support and the photosensitive layer (charge generation layer, charge transport layer), or between the conductive layer and the photosensitive layer. The intermediate layer is formed for the improvement of the adhesion of the photosensitive layer, improvement of the coatability, improvement of the charge injection property from the support, and for the protection against electrical breakdown of the photosensitive layer.

The intermediate layer may be formed using resins such as acrylic resins, allyl resins, alkyd resins, ethylcellulose resins, ethylene-acrylic acid copolymers, epoxy resins, casein resins, silicone resins, gelatin resins, nylons, phenol resins, butyral resins, polyacrylate resins, polyacetal resins, polyamideimide resins, polyamide resins, polyallyl ether resins, polyimide resins, polyurethane resins, polyester resins, polyethylene resins, polycarbonate resins, polystyrene resins, polysulfone resins, polyvinylalcohol resins, polybutadiene resins, polypropylene resin and urea resin, or materials such as aluminum oxide.

The intermediate layer has a layer thickness of preferably 0.05 to 5 μm, more preferably 0.3 to 1 μm.

Examples of charge generation materials used for the electrophotographic photosensitive member of the present invention include azo pigments such as monoazo, disazo and trisazo pigments, phthalocyanine pigments such as metal phthalocyanines and metal-free phthalocyanines, indigo pigments such as indigo and thioindigo pigments, perylene pigments such as perylene acid anhydrides and perylene acid imides, polycyclic quinone pigments such as anthraquinone, pyrenequinone and dibenzopyrenequinone, squarilium dyes, pyrylium salts, thiapyrylium salts, triphenylmethane dyes, inorganic materials such as selenium, selenium-tellurium and amorphous silicon, quinacridone pigments, azulenium salt pigments, cyanine dyes such as quinocyanine, anthanthrone dyes, pyranthron dyes, xanthene dyes, quinoneimine dyes, styryl dyes, cadmium sulfide and zinc oxide. These charge generation materials may be used alone or in a combination of two or more.

When the photosensitive layer is a multi-layer type photosensitive layer and the charge generation layer does not constitute the surface layer of the electrophotographic photosensitive member, examples of binder resins used for the charge generation layer include acrylic resins, allyl resins, alkyd resins, epoxy resins, diallyl phthalate resins, silicone resins, styrene-butadiene copolymers, nylons, phenol resins, butyral resins, benzal resins, polyacrylate resins, polyacetal resins, polyamideimide resins, polyamide resins, polyarylether resins, polyarylate resins, polyimide resins, polyurethane resins, polyester resins, polyethylene resins, polycarbonate resins, polystyrene resins, polysulfone resins, polyvinylacetal resins, polybutadiene resins, polypropylene resins, methacrylic resins, urea resins, vinyl chloride-vinyl acetate copolymers, vinyl acetate resins and vinyl chloride resins. Particularly, butyral resins and the like are preferred. These may be used alone or in a combination or as a copolymer of two or more.

When the charge generation layer constitutes the surface layer of the electrophotographic photosensitive member, at least an aliphatic dicarboxylic acid polyester resin with a weight average molecular weight of 80,000 or more having a repeating structural unit represented by the above formula (1) is used for the charge generation layer as a binder resin. Although other resins listed above may be used together within the limit that the effect of the present invention is not damaged, the proportion in the charge generation layer of the aliphatic dicarboxylic acid polyester resin with a weight average molecular weight of 80,000 or more having a repeating structural unit represented by the above formula (1) is 50% by mass or more based on the total mass of the binder resin contained in the charge generation layer.

The charge generation layer may be formed by coating a charge generation layer coating solution obtained by dispersing a charge generation material with a binder resin and a solvent and drying the same. Methods of dispersion include those using a homogenizer, an ultrasonic dispersing machine, a ball mill, a sand mill, a roll mill, a vibration mill, an attritor or a liquid collision high-speed dispersing machine. The proportion of the charge generation material to the binder resin is preferably in the range of 1:0.3 to 1:4 (mass ratio).

The solvent used for the charge generation layer coating solution is selected depending on the solubility and dispersion stability of the binder resin and the charge generation material to be used. Examples of organic solvents include alcohols, sulfoxides, ketones, ethers, esters, aliphatic halogenated hydrocarbons and aromatic compounds.

The charge generation layer has a layer thickness of preferably 5 μm or less, more preferably 0.1 to 2 μm.

Various sensitizers, antioxidants, ultraviolet absorbers and/or plasticizers may be added to the charge generation layer according to need.

Examples of charge transport materials used for the electrophotographic photosensitive member of the present invention include triarylamine compounds, hydrazone compounds, styryl compounds, stilbene compounds, pyrazoline compounds, oxazole compounds, thiazole compounds and triarylmethane compounds. These charge transport materials may be used alone or in a combination of two or more.

When the photosensitive layer is a multi-layer type photosensitive layer and the charge transport layer does not constitute the surface layer of the electrophotographic photosensitive member, examples of binder resins used for the charge transport layer include acrylic resins, acrylonitrile resins, allyl resins, alkyd resins, epoxy resins, silicone resins, nylons, phenol resins, phenoxy resins, butyral resins, polyacrylamide resins, polyacetal resins, polyamideimide resins, polyamide resins, polyarylether resins, polyarylate resins, polyimide resins, polyurethane resins, polyester resins, polyethylene resins, polycarbonate resins, polystyrene resins, polysulfone resins, polyvinylbutyral resins, polyphenyleneoxide resins, polybutadiene resins, polypropylene resins, methacrylic resins, urea resins, vinyl chloride resins and vinyl acetate resins. Of these, polyallylate resins and polycarbonate resins are preferred. These may be used alone or in a combination or as a copolymer of two or more.

When the charge transport layer constitutes the surface layer of the electrophotographic photosensitive member, at least an aliphatic dicarboxylic acid polyester resin with a weight average molecular weight of 80,000 or more having a repeating structural unit represented by the above formula (1) is used for the charge transport layer as a binder resin. Although other resins listed above may be used together within the limit that the effect of the present invention is not damaged, the proportion in the charge transport layer of the aliphatic dicarboxylic acid polyester resin with a weight average molecular weight of 80,000 or more having a repeating structural unit represented by the above formula (1) is preferably 50% by mass or more based on the total mass of the binder resin contained in the charge transport layer.

The charge transport layer may be formed by coating a charge transport layer coating solution obtained by dispersing a charge transport material with a binder resin and a solvent and drying the same. The proportion of the charge transport material to the binder resin is preferably in the range of 2:1 to 1:2 (mass ratio).

Examples of solvents used for the charge transport layer coating solution include ketones such as acetone and methyl ethyl ketone, esters such as methyl acetate and ethyl acetate, aromatic hydrocarbons such as toluene and xylene, ethers such as 1,4-dioxane and tetrahydrofuran, and hydrocarbons substituted by a halogen atom such as chlorobenzene, chloroform and carbon tetrachloride.

The charge transport layer has a layer thickness of preferably 5 to 40 μm, more preferably 10 to 35 μm.

An antioxidant, an ultraviolet absorber and/or a plasticizer may be added to the charge transport layer according to need.

When the photosensitive layer is a single layer type photosensitive layer and the single layer type photosensitive layer does not constitute the surface layer of the electrophotographic photosensitive member, the single layer type photosensitive layer may be formed by coating a single layer type photosensitive layer coating solution obtained by dispersing the above-described charge generation material and charge transport material with a binder resin and the above-described solvent and drying the same.

When the photosensitive layer is a single layer type photosensitive layer and the single layer type photosensitive layer does not constitute the surface layer of the electrophotographic photosensitive member, the above-described various resins may be used as a binder resin for the single layer type photosensitive layer.

When the single layer type photosensitive layer constitute the surface layer of the electrophotographic photosensitive member, at least an aliphatic dicarboxylic acid polyester resin with a weight average molecular weight of 80,000 or more having a repeating structural unit represented by the above formula (1) is used for the single layer type photosensitive layer as a binder resin. Although other resins listed above may be used together within the limit that the effect of the present invention is not damaged, the proportion in the single layer type photosensitive layer of the aliphatic dicarboxylic acid polyester resin with a weight average molecular weight of 80000 or more having a repeating structural unit represented by the above formula (1) is preferably 50% by mass or more based on the total mass of the binder resin contained in the single layer type photosensitive layer.

As described above, a protective layer for protecting the photosensitive layer may be formed on the photosensitive layer. The protective layer may be formed by coating a protective layer coating solution obtained by dissolving a binder resin in a solvent and drying the same.

At least an aliphatic dicarboxylic acid polyester resin with a weight average molecular weight of 80,000 or more having a repeating structural unit represented by the above formula (1) is used for the protective layer which constitutes the surface layer of the electrophotographic photosensitive member as a binder resin. Other resins listed above may be used together within the limit that the effect of the present invention is not damaged, but in that case, the proportion in the protective layer of the aliphatic dicarboxylic acid polyester resin with a weight average molecular weight of 80,000 or more having a repeating structural unit represented by the above formula (1) is preferably 50% by mass or more based on the total mass of the binder resin contained in the protective layer.

The protective layer has a layer thickness of preferably 0.5 to 10 μm, more preferably 1 to 5 μm.

When coating the above-described coating solution for each layer, a coating method such as dip coating, spray coating, spinner coating, roller coating, Mayer bar coating or blade coating may be used.

Figure 2:
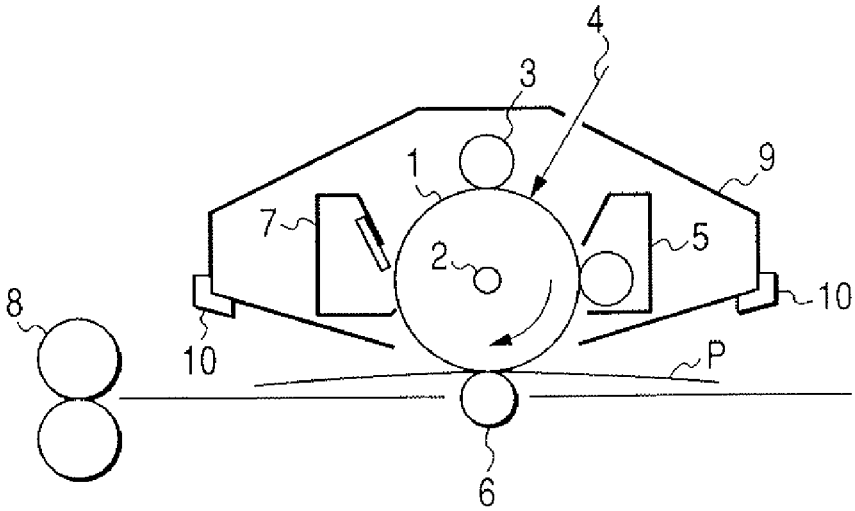
FIG. 2 schematically illustrates an example of a structure of an electrophotographic apparatus equipped with a process cartridge containing the electrophotographic photosensitive member of the present invention.

FIG. 2 shows an example of a schematic structure of an electrophotographic apparatus equipped with a process cartridge containing the electrophotographic photosensitive member of the present invention.

Referring to FIG. 2, reference numeral 1 denotes a cylindrical electrophotographic photosensitive member, which is rotationally driven around the axis 2 in the direction of the arrow at a constant peripheral speed.

The surface of the rotationally driven electrophotographic photosensitive member 1 is uniformly charged to a pre-determined positive or negative potential by a charging means 3 (primary charging means: charging roller, etc.), and receives exposure light (image exposure light) 4 emitted from an exposure means (not shown) in the form of slit exposure or laser beam scanning exposure. In this way, electrostatic latent images corresponding to the intended images are formed one after another on the surface of the electrophotographic photosensitive member 1.

The electrostatic latent image formed on the surface of the electrophotographic photosensitive member 1 is developed by toner contained in a developer stored in a developing means 5 to be converted to a toner image. Then, the toner image formed and held on the surface of the electrophotographic photosensitive member 1 is continuously transferred to a transfer material P (e.g., paper) which is fed from a transfer material feeding means (not shown) by a transferring bias from a transferring means 6 (e.g., a transferring roller) simultaneously with the rotation of the electrophotographic photosensitive member 1 into the zone (contact zone) between the electrophotographic photosensitive member 1 and the transferring means 6.

The transfer material P to which the toner images have been transferred is separated from the surface of the electrophotographic photosensitive member 1, led to a fixing means 8 where the toner images are fixed, and then printed out from the apparatus as an image-formed material (a print or a copy).

The surface of the electrophotographic photosensitive member 1 from which the toner images have been transferred is cleaned by removing the developer (toner) remaining after transfer by a cleaning means 7 (cleaning blade, etc). The electrophotographic photosensitive member 1 is then subjected to charge elimination using pre-exposure light (not shown) from a pre-exposure means (not shown), and used for forming images again. When the charging means 3 is a contact charging means using a charging roller as shown in FIG. 2, pre-exposure is not necessarily required.

A plurality of the above-described constituents of the electrophotographic photosensitive member 1, the charging means 3, the developing means 5, the transferring means 6 and the cleaning means 7 may be stored in a container so as to form an integral process cartridge, which may be configured to be detachably attached to the body of an electrophotographic apparatus such as a copying machine or a laser beam printer. Referring to FIG. 2, the electrophotographic photosensitive member 1, the charging means 3, the developing means 5 and the cleaning means 7 are integrally held as a cartridge to form a process cartridge 9 detachably attached to the body of the electrophotographic apparatus using a guiding means 10 such as a rail of the body of the electrophotographic apparatus.

Figure 3:
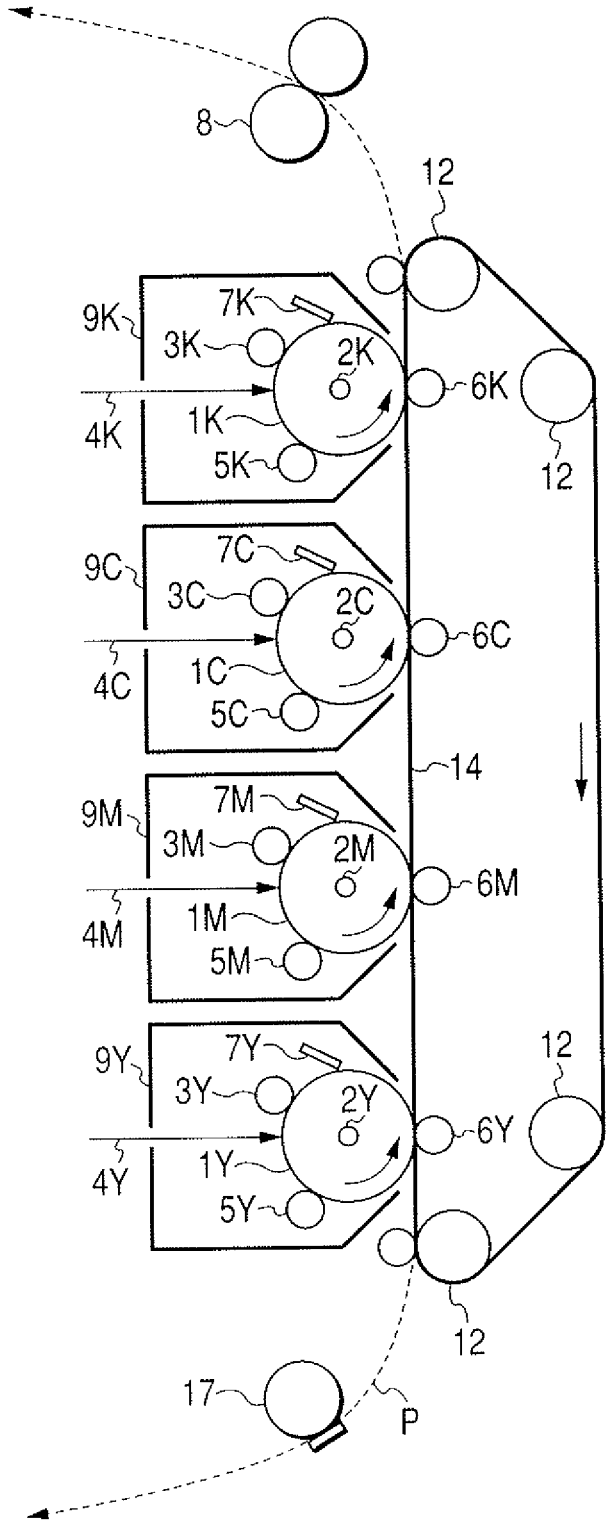
FIG. 3 schematically illustrates an example of a structure of a color electrophotographic apparatus (in-line system) equipped with a process cartridge containing the electrophotographic photosensitive member of the present invention.

FIG. 3 shows an example of a schematic structure of a color electrophotographic apparatus (in-line system) equipped with a process cartridge containing the electrophotographic photosensitive member of the present invention.

Referring to FIG. 3, reference numerals 1Y, 1M, 1C and 1K denote cylindrical electrophotographic photosensitive members (the first to fourth color electrophotographic photosensitive members), which are each rotationally driven around the axes 2Y, 2M, 2C and 2K in the direction of the arrows at pre-determined peripheral speeds.

The surface of the rotationally driven first color electrophotographic photosensitive member 1Y is uniformly charged to a pre-determined positive or negative potential by a first color charging means (primary charging means: charging roller, etc) 3Y, and receives exposure light (image exposure light) 4Y emitted from an exposure means (not shown) in the form of slit exposure or laser beam scanning exposure. The exposure light 4Y corresponds to a first color component image (e.g., yellow component image) of the intended color image. In this way, the first color component electrostatic latent images (yellow component electrostatic latent images) corresponding to the first color component images of the intended color images are formed one after another on the surface of the first color electrophotographic photosensitive member 1Y.

A transfer material carrying member (transfer material carrying belt) 14 stretched by stretching rollers 12 is rotationally driven in the direction of the arrow at a peripheral speed substantially the same as that of the first to fourth color electrophotographic photosensitive members 1Y, 1M, 1C and 1K (e.g., 97 to 103% of the peripheral speed of the first to fourth color electrophotographic photosensitive members 1Y, 1M, 1C and 1K). A transfer material (e.g., paper) P fed from a transfer material feeding means 17 is electrostatically held (adsorbed) on the transfer material carrying member 14, and continuously carried to the zone (contact zone) between the first to forth electrophotographic photosensitive members 1Y, 1M, 1C, 1K and the transfer material carrying member.

The first color component electrostatic latent image formed on the surface of the first color electrophotographic photosensitive member 1Y is developed by toner in the first color developing means 5Y to form a first color toner image (yellow toner image). Then, the first color toner image formed and held on the surface of the first color electrophotographic photosensitive member 1Y is continuously transferred to a transfer material P which is held by the transfer material carrying member 14 and passes through the first color electrophotographic photosensitive member 1Y and the first color transferring means 6Y, by a transferring bias from the first color transferring means (transferring roller, etc.) 6Y.

The surface of the first color electrophotographic photosensitive member 1Y from which the first color toner images have been transferred is cleaned by removing toner remaining after transfer by a first color cleaning means 7Y (cleaning blade, etc), and the member is used for forming the first color toner image again.

The first color electrophotographic photosensitive member 1Y, the first color charging means 3Y, the first color exposure means emitting exposure light 4Y corresponding to the first color component image, the first color developing means 5Y and the first color transferring means 6Y are collectively referred to as a first color image forming unit.

Operations of the second color image forming unit including the second color electrophotographic photosensitive member 1M, the second color charging means 3M, the second color exposure means emitting exposure light 4M corresponding to the second color component image, the second color developing means 5M and the second color transferring means 6M, the third color image forming unit including the third color electrophotographic photosensitive member 1C, the third color charging means 3C, the third color exposure means emitting exposure light 4C corresponding to the third color component image, the third color developing means 5C and the third color transferring means 6C, and the fourth color image forming unit including the fourth color electrophotographic photosensitive member 1K, the fourth color charging means 3K, the fourth color exposure means emitting exposure light 4K corresponding to the fourth color component image, the fourth color developing means 5K and the fourth color transferring means 6K are the same as the operation of the first color image forming unit. The second color toner image (magenta toner image), the third color toner image (cyan toner image) and the fourth color toner image (black toner image) are continuously transferred to the transfer material P which is held by the transfer material carrying member 14 and to which the first color toner image is transferred. In this way, synthesized toner images corresponding to the intended color images are formed on the transfer material P held by the transfer material carrying member 14.

The transfer material P on which the synthesized toner images have been formed is separated from the surface of the transfer material carrying member 14, led to a fixing means 8 where the toner images are fixed, and then printed out from the apparatus as a color image-formed material (a print or a copy).

The surface of the first to fourth color electrophotographic photosensitive members 1Y, 1M, 1C and 1K after removing toner remaining after transfer by the first to fourth color cleaning means 7Y, 7M, 7C and 7K may be subjected to charge elimination by exposure light from a pre-exposure means. However, when the first to fourth color charging means 3Y, 3M, 3C and 3K are contact charging means using a charging roller as shown in FIG. 3, pre-exposure is not necessarily required.

A plurality of the above-described constituents of the electrophotographic photosensitive members, the charging means, the developing means, the transferring means and the cleaning means may be stored in a container so as to form an integral process cartridge, which may be configured to be detachably attached to the body of an electrophotographic apparatus such as a copying machine or a laser beam printer. Referring to FIG. 3, for each image forming unit, the electrophotographic photosensitive member, the charging means, the developing means and the cleaning means are integrally held as a cartridge to form process cartridges 9Y, 9M, 9C and 9K detachably attached to the body of the electrophotographic apparatus using a guiding means such as a rail (not shown) of the body of the electrophotographic apparatus.

In the following, the present invention will be described in more detail with reference to specific Examples, but the present invention is not limited thereto. In Examples, "part(s)" means "part(s) by mass" and "Mw" means "weight average molecular weight".

Example 1-1

An aluminum cylinder 30 mm in diameter and 260.5 mm in length was used as a support.

10 parts of $SnO_2$ coated barium sulfate (conductive particles), 2 parts of titanium oxide (resistance control pigment), 6 parts of a phenol resin (binder resin), 0.001 part of silicone oil (leveling agent) and a mixed solvent of 4 parts of methanol/16 parts of methoxypropanol were used to prepare a conductive layer coating solution.

The conductive layer coating solution was dip-coated on the support and cured (thermally cured) at 140° C. for 30 minutes to form a conductive layer of 15 μm in layer thickness.

Then, 3 parts of N-methoxymethylated nylon and 3 parts of copolymerized nylon were then dissolved in a mixed solvent of 65 parts of methanol/30 parts of n-butanol to prepare an intermediate layer coating solution.

The intermediate layer coating solution was dip-coated on the conductive layer and dried at 100° C. for 10 minutes to form an intermediate layer of 0.7 μm in layer thickness.

Then, 10 parts of hydroxygallium phthalocyanine (charge generation material) of a crystal form having strong peaks at Bragg angles 2θ±0.2° of 7.5°, 9.9°, 16.3°, 18.6°, 25.1° and 28.3° in CuKα characteristic X-ray diffraction was added to a solution in which 5 parts of a polyvinyl butyral resin (commercial name: S-LEC BX-1, available from Sekisui Chemical Co., Ltd.) was dissolved in 250 parts of cyclohexanone, and they were subjected to dispersion for 1 hour by a sand mill using glass beads 1 mm in diameter at an atmosphere of 23±3° C. After the dispersion, 250 parts of ethyl acetate was added thereto to form a charge generation layer coating solution.

The charge generation layer coating solution was dip-coated on the intermediate layer and dried at 100° C. for 10 minutes to form a charge generation layer of 0.26 μm in layer thickness.

Then, 8 parts of an amine compound (charge transport material) having a structure represented by the following formula (CTM-1):

(CTM-1)

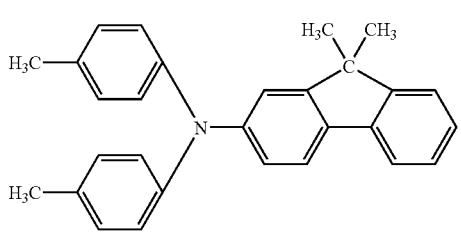

and 10 parts of an aliphatic dicarboxylic acid polyester resin (binder resin, homopolymer, Mw: 150000) having a repeating structural unit represented by the above formula (1-2) were dissolved in 80 parts of monochlorobenzene to prepare a charge transport layer coating solution.

The charge transport layer coating solution was dip-coated on the charge generation layer and dried at 120° C. for 1 hour to form a charge transport layer of 19 μm in layer thickness.

An electrophotographic photosensitive member in which the charge transport layer constitutes the surface layer was thus prepared.

Evaluation processes will now be described. Light portion potentials, fluctuation in dark portion potentials after a durability test and abrasion amounts of the surface were evaluated.

As evaluation equipment, laser beam printer LBP-2510 (charge (primary charge): contact charge system, processing speed: 94.2 mm/s) made by Canon Inc. and modified so as to control the charged potential (dark portion potential) of the electrophotographic photosensitive member was used.

The evaluation was performed in an environment of 10° C. and 10% RH.

The exposure (exposure for images) of the 780 nm laser source of the evaluation equipment was determined so that the light quantity on the surface of the electrophotographic photosensitive member was 0.3 μJ/cm$^2$.

Surface potentials (dark portion potential and light portion potential) of the electrophotographic photosensitive member were measured at the position of the developing unit after replacing the developing unit with a jig fixed so that a probe for measuring potential was located at a position 130 mm from the end of the electrophotographic photosensitive member.

The dark portion potential (VD) of the unexposed portion of the electrophotographic photosensitive member was set to −450 V, and by irradiating with laser beam, the light portion potential (VL) after light attenuation from the dark portion potential (VD) was evaluated.

Further, using A4 plain paper, 2,000 pieces of images were continuously outputted, and the fluctuation (ΔVD) in the dark portion potential (VD) before and after the output was evaluated.

$$\Delta VD = (VD \text{ after outputting 2,000 pieces of images}) - (\text{initial } VD)$$

Also, using A4 plain paper, 5,000 pieces of images were outputted in an intermittent mode in which output of images is suspended per piece, and after 5,000 pieces of images were outputted, the abrasion amount of the surface of the electrophotographic photosensitive member from the beginning was evaluated. The layer thickness at the time was measured using a film thickness meter, Fischer MMS Eddy Current Probe EAW 3.3 made by Fischer Instruments K.K.

The results are shown in Table 4.

Examples 1-2 to 1-47, Comparative Examples 1-1 to 1-25

An electrophotographic photosensitive member in which the charge transport layer constitutes the surface layer was prepared and evaluated in the same manner as in Example 1-1 except that the binder resin of the charge transport layer in Example 1-1 was changed to those described in Tables 1 to 3. The results are shown in Table 4.

TABLE 1

| | Binder resin of charge transport layer | | | | | | | |
|---|---|---|---|---|---|---|---|---|
| | Binder resin (A) | | | | Binder resin (B) | | | |
| | Repeating structural unit (a) | Repeating structural unit (b) | Mw | Type of polymerization | Repeating structural unit | Mw | Type of polymerization | Remarks |
| Ex. 1-1 | (1-2) | — | 150000 | Homopolymer | — | — | — | — |
| 1-2 | (1-5) | — | 150000 | Homopolymer | — | — | — | — |
| 1-3 | (1-11) | — | 100000 | Homopolymer | — | — | — | — |
| 1-4 | (1-13) | — | 180000 | Homopolymer | — | — | — | — |
| 1-5 | (1-15) | — | 120000 | Homopolymer | — | — | — | — |
| 1-6 | (1-20) | — | 200000 | Homopolymer | — | — | — | — |
| 1-7 | (1-29) | — | 150000 | Homopolymer | — | — | — | — |
| 1-8 | (1-33) | — | 100000 | Homopolymer | — | — | — | — |
| 1-9 | (1-37) | — | 90000 | Homopolymer | — | — | — | — |
| 1-10 | (1-45) | — | 130000 | Homopolymer | — | — | — | — |
| 1-11 | (1-1) | — | 115000 | Homopolymer | — | — | — | — |
| 1-12 | (1-3) | — | 125000 | Homopolymer | — | — | — | — |
| 1-13 | (1-4) | — | 140000 | Homopolymer | — | — | — | — |
| 1-14 | (1-6) | — | 160000 | Homopolymer | — | — | — | — |
| 1-15 | (1-7) | — | 100000 | Homopolymer | — | — | — | — |
| 1-16 | (1-8) | — | 120000 | Homopolymer | — | — | — | — |
| 1-17 | (1-9) | — | 160000 | Homopolymer | — | — | — | — |
| 1-18 | (1-14) | — | 110000 | Homopolymer | — | — | — | — |
| 1-19 | (1-16) | — | 170000 | Homopolymer | — | — | — | — |
| 1-20 | (1-17) | — | 200000 | Homopolymer | — | — | — | — |
| 1-21 | (1-18) | — | 150000 | Homopolymer | — | — | — | — |
| 1-22 | (1-19) | — | 165000 | Homopolymer | — | — | — | — |
| 1-23 | (1-21) | — | 140000 | Homopolymer | — | — | — | — |
| 1-24 | (1-22) | — | 140000 | Homopolymer | — | — | — | — |
| 1-25 | (1-23) | — | 100000 | Homopolymer | — | — | — | — |
| 1-26 | (1-24) | — | 100000 | Homopolymer | — | — | — | — |
| 1-27 | (1-27) | — | 150000 | Homopolymer | — | — | — | — |
| 1-28 | (1-35) | — | 120000 | Homopolymer | — | — | — | — |
| 1-29 | (1-36) | — | 170000 | Homopolymer | — | — | — | — |
| 1-30 | (1-38) | — | 155000 | Homopolymer | — | — | — | — |
| 1-31 | (1-39) | — | 135000 | Homopolymer | — | — | — | — |
| 1-32 | (1-40) | — | 250000 | Homopolymer | — | — | — | — |

TABLE 1-continued

| | Binder resin of charge transport layer | | | | | | | |
|---|---|---|---|---|---|---|---|---|
| | Binder resin (A) | | | | Binder resin (B) | | | |
| | Repeating structural unit (a) | Repeating structural unit (b) | Mw | Type of polymerization | Repeating structural unit | Mw | Type of polymerization | Remarks |
| 1-33 | (1-41) | — | 170000 | Homopolymer | — | — | — | — |
| 1-34 | (1-42) | — | 110000 | Homopolymer | — | — | — | — |
| 1-35 | (1-43) | — | 140000 | Homopolymer | — | — | — | — |
| 1-36 | (1-44) | — | 135000 | Homopolymer | — | — | — | — |
| 1-37 | (1-46) | — | 120000 | Homopolymer | — | — | — | — |

TABLE 2

| | Binder resin of charge transport layer | | | | | | | |
|---|---|---|---|---|---|---|---|---|
| | Binder resin (A) | | | | Binder resin (B) | | | |
| | Repeating structural unit (a) | Repeating structural unit (b) | Mw | Type of polymerization | Repeating structural unit | Mw | Type of polymerization | Remarks |
| Ex. 1-38 | (1-5) | (1-13) | 150000 | Binary opolymer a:b = 5:5 (molar ratio) | — | — | — | — |
| 1-39 | (1-5) | (1-20) | 180000 | Binary copolymer a:b = 3:7 (molar ratio) | — | — | — | — |
| 1-40 | (1-5) | (1-40) | 125000 | Binary copolymer a:b = 5:5 (molar ratio) | — | — | — | — |
| 1-41 | (1-13) | (1-27) | 100000 | Binary copolymer a:b = 5:5 (molar ratio) | — | — | — | — |
| 1-42 | (1-13) | (1-45) | 140000 | Binary copolymer a:b = 5:5 (molar ratio) | — | — | — | — |
| 1-43 | (1-33) | (1-34) | 170000 | Binary copolymer a:b = 5:5 (molar ratio) | — | — | — | — |
| 1-44 | (1-33) | (1-40) | 100000 | Binary copolymer a:b = 5:5 (molar ratio) | — | — | — | — |
| 1-45 | (1-40) | (1-45) | 120000 | Binary copolymer a:b = 3:7 (molar ratio) | — | — | — | — |
| 1-46 | (1-5) | — | 150000 | Homopolymer | (1-13) | 180000 | Homopolymer | Two kinds mixed A:B = 5:5 (weight ratio) |
| 1-47 | (1-33) | — | 100000 | Homopolymer | (1-34) | 125000 | Homopolymer | Two kinds mixed A:B = 5:5 (weight ratio) |

TABLE 3

| | Binder resin of charge transport layer | | | | | | | |
|---|---|---|---|---|---|---|---|---|
| | Binder resin (A) | | | | Binder resin (B) | | | |
| | Repeating structural unit (a) | Repeating structural unit (b) | Mw | Type of polymerization | Repeating structural unit | Mw | Type of polymerization | Remarks |
| Com. 1-1 | (1-2) | — | 60000 | Homopolymer | — | — | — | — |
| Ex. 1-2 | (1-5) | — | 50000 | Homopolymer | — | — | — | — |
| 1-3 | (1-11) | — | 50000 | Homopolymer | — | — | — | — |
| 1-4 | (1-13) | — | 70000 | Homopolymer | — | — | — | — |

TABLE 3-continued

| | Binder resin of charge transport layer | | | | | | | |
|---|---|---|---|---|---|---|---|---|
| | Binder resin (A) | | | | Binder resin (B) | | | |
| | Repeating structural unit (a) | Repeating structural unit (b) | Mw | Type of polymerization | Repeating structural unit | Mw | Type of polymerization | Remarks |
| 1-5 | (1-15) | — | 60000 | Homopolymer | — | — | — | — |
| 1-6 | (1-20) | — | 40000 | Homopolymer | — | — | — | — |
| 1-7 | (1-29) | — | 50000 | Homopolymer | — | — | — | — |
| 1-8 | (1-33) | — | 45000 | Homopolymer | — | — | — | — |
| 1-9 | (1-37) | — | 50000 | Homopolymer | — | — | — | — |
| 1-10 | (1-45) | — | 50000 | Homopolymer | — | — | — | — |
| 1-11 | (C-1) | — | 120000 | Homopolymer | — | — | — | — |
| 1-12 | (C-2) | — | 140000 | Homopolymer | — | — | — | — |
| 1-13 | (C-3) | — | 130000 | Homopolymer | — | — | — | — |
| 1-14 | (C-4) | — | 160000 | Homopolymer | — | — | — | — |
| 1-15 | (C-5) | — | 150000 | Homopolymer | — | — | — | — |
| 1-16 | (C-6) | — | 120000 | Homopolymer | — | — | — | — |
| 1-17 | (C-7) | — | 180000 | Homopolymer | — | — | — | — |
| 1-18 | (C-8) | — | 130000 | Homopolymer | — | — | — | — |
| 1-19 | (C-9) | — | 180000 | Homopolymer | — | — | — | — |
| 1-20 | (C-10) | — | 130000 | Homopolymer | — | — | — | — |
| 1-21 | (C-11) | — | 130000 | Homopolymer | — | — | — | — |
| 1-22 | (C-12) | — | 110000 | Homopolymer | — | — | — | — |
| 1-23 | (C-13) | — | 130000 | Homopolymer | — | — | — | — |

In Table 3, (C-1) to (C-13) are as described below.

(C-1)

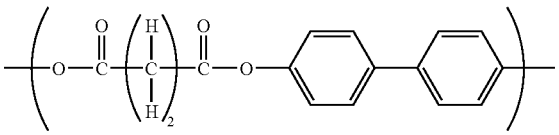

(C-2)

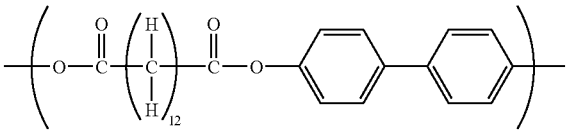

(C-3)

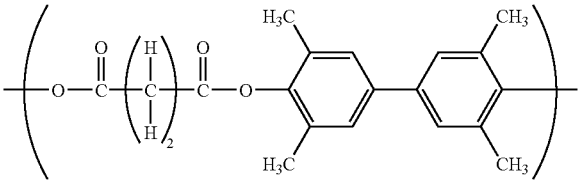

(C-4)

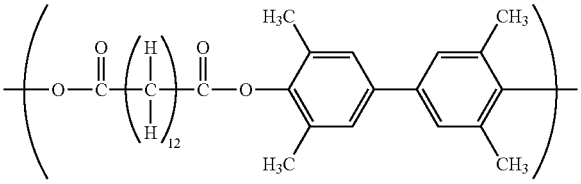

-continued (C-5)

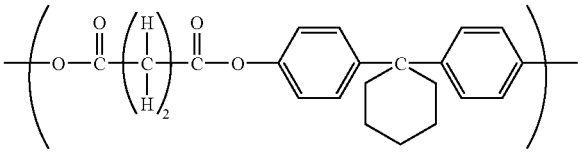

(C-6)

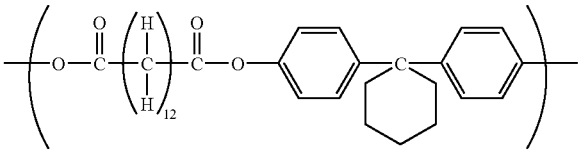

(C-7)

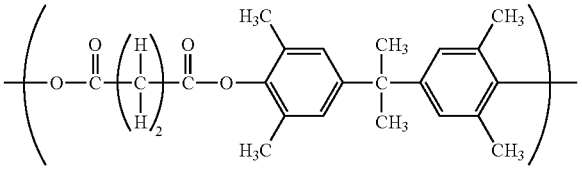

(C-8)

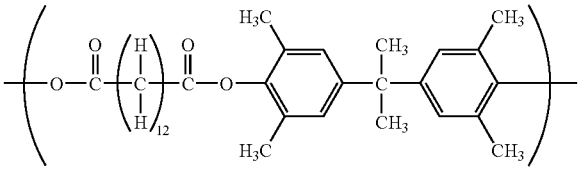

(C-9)

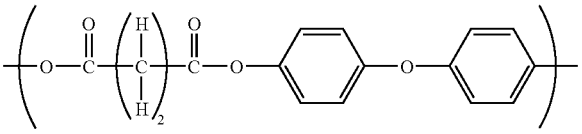

-continued (C-10)

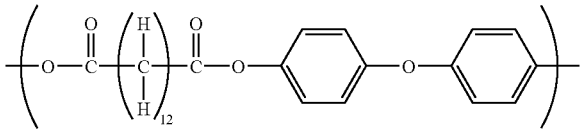

(C-11)

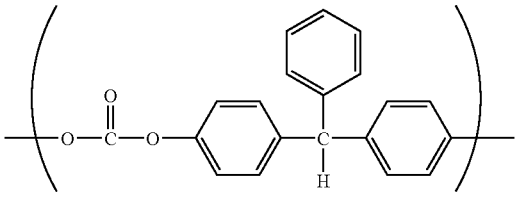

(C-12)

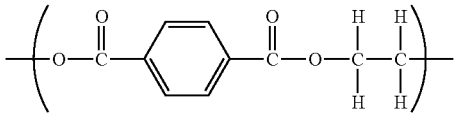

(C-13)

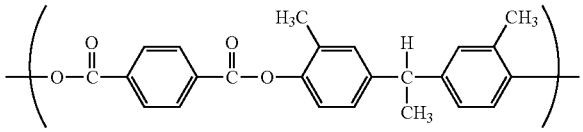

TABLE 4

| | | VL [−V] | ΔVD [V] | Abrasion amount [μm] |
|---|---|---|---|---|
| Ex. | 1-1 | 88 | +15 | 1.3 |
| | 1-2 | 85 | +10 | 1.0 |
| | 1-3 | 88 | +15 | 1.3 |
| | 1-4 | 85 | +15 | 0.9 |
| | 1-5 | 88 | +15 | 1.3 |
| | 1-6 | 85 | +10 | 0.9 |
| | 1-7 | 85 | +15 | 1.3 |
| | 1-8 | 85 | +15 | 0.9 |
| | 1-9 | 87 | +10 | 1.0 |
| | 1-10 | 85 | +15 | 0.9 |
| | 1-11 | 88 | +10 | 1.3 |
| | 1-12 | 85 | +10 | 1.0 |
| | 1-13 | 85 | +10 | 0.9 |
| | 1-14 | 85 | +15 | 1.0 |
| | 1-15 | 88 | +15 | 1.0 |
| | 1-16 | 88 | +10 | 1.2 |
| | 1-17 | 88 | +15 | 1.2 |
| | 1-18 | 85 | +10 | 1.3 |
| | 1-19 | 86 | +15 | 1.0 |
| | 1-20 | 85 | +10 | 0.9 |
| | 1-21 | 85 | +15 | 1.3 |
| | 1-22 | 88 | +15 | 1.0 |
| | 1-23 | 88 | +15 | 1.2 |
| | 1-24 | 88 | +15 | 1.3 |
| | 1-25 | 88 | +15 | 1.3 |
| | 1-26 | 85 | +10 | 1.0 |

TABLE 4-continued

| | | VL [−V] | ΔVD [V] | Abrasion amount [μm] |
|---|---|---|---|---|
| | 1-27 | 88 | +15 | 1.0 |
| | 1-28 | 88 | +15 | 1.3 |
| | 1-29 | 85 | +10 | 1.2 |
| | 1-30 | 88 | +15 | 0.9 |
| | 1-31 | 85 | +10 | 0.9 |
| | 1-32 | 89 | +15 | 0.9 |
| | 1-33 | 88 | +15 | 1.0 |
| | 1-34 | 85 | +10 | 0.9 |
| | 1-35 | 88 | +15 | 1.2 |
| | 1-36 | 88 | +15 | 1.2 |
| | 1-37 | 88 | +15 | 1.3 |
| | 1-38 | 85 | +10 | 1.0 |
| | 1-39 | 85 | +10 | 1.0 |
| | 1-40 | 88 | +15 | 1.0 |
| | 1-41 | 89 | +15 | 1.0 |
| | 1-42 | 85 | +10 | 0.9 |
| | 1-43 | 86 | +10 | 0.9 |
| | 1-44 | 89 | +15 | 1.0 |
| | 1-45 | 86 | +10 | 1.0 |
| | 1-46 | 87 | +15 | 1.0 |
| | 1-47 | 87 | +15 | 1.0 |
| Com. | 1-1 | 92 | −45 | 3.7 |
| Ex. | 1-2 | 88 | −40 | 3.6 |
| | 1-3 | 91 | −45 | 3.7 |
| | 1-4 | 88 | −45 | 3.4 |
| | 1-5 | 90 | −45 | 3.7 |
| | 1-6 | 88 | −40 | 3.5 |
| | 1-7 | 88 | −45 | 3.7 |
| | 1-8 | 88 | −45 | 3.6 |
| | 1-9 | 88 | −40 | 3.5 |
| | 1-10 | 88 | −45 | 3.6 |
| | 1-11 | 95 | −30 | 2.4 |
| | 1-12 | 93 | −33 | 2.0 |
| | 1-13 | 93 | −28 | 2.2 |
| | 1-14 | 93 | −25 | 1.8 |
| | 1-15 | 95 | −30 | 2.4 |
| | 1-16 | 93 | −28 | 2.0 |
| | 1-17 | 93 | −30 | 2.2 |
| | 1-18 | 93 | −28 | 1.7 |
| | 1-19 | 93 | −30 | 2.2 |
| | 1-20 | 93 | −28 | 1.7 |
| | 1-21 | 89 | −45 | 4.3 |
| | 1-22 | 98 | +40 | 1.7 |
| | 1-23 | 95 | +40 | 1.5 |

Example 2-1

An aluminum plate was used as a support.

3 parts of N-methoxymethylated nylon and 3 parts of copolymerized nylon were then dissolved in a mixed solvent of 65 parts of methanol/30 parts of n-butanol to prepare an intermediate layer coating solution.

The intermediate layer coating solution was coated on the support by a Mayer bar and dried at 100° C. for 10 minutes to form an intermediate layer of 0.7 μm in layer thickness.

Then, 20 parts of azo pigment (charge generation material) having a structure represented by the following formula (CGM-1)

(CGM-1)

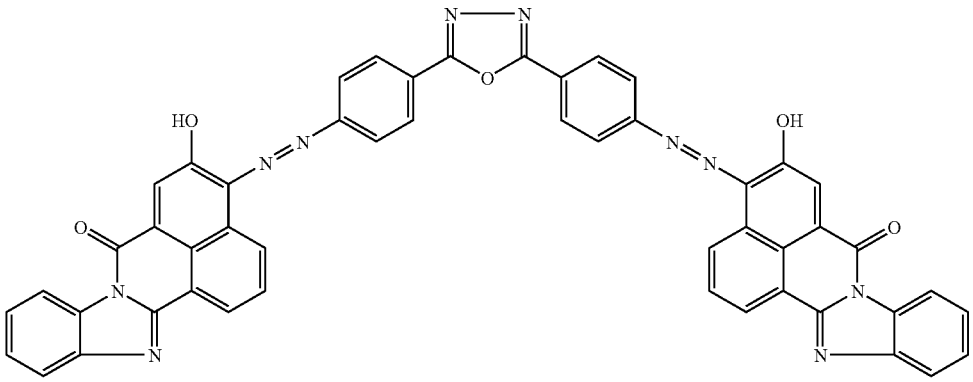

and 10 parts of a butyral resin (butylation degree: 65 mol %) were added to 400 parts of tetrahydrofuran, and they were subjected to dispersion for 20 hours by a sand mill using glass beads 1 mm ind diameter at an atmosphere of 23±3° C. to prepare a charge generation layer coating solution.

The charge generation layer coating solution was coated on the intermediate layer by a Mayer bar and dried at 100° C. for 10 minutes to form a charge generation layer of 0.4 μm in layer thickness.

Then, 8 parts of an amine compound (charge transport material) having a structure represented by the following formula (CTM-2)

(CTM-2)

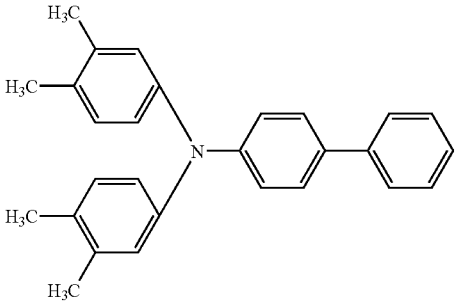

and 10 parts of an aliphatic dicarboxylic acid polyester resin (binder resin, homopolymer, Mw: 150,000) having a repeating structural unit represented by the above formula (1-2) were dissolved in 80 parts of monochlorobenzene to prepare a charge transport layer coating solution.

The charge transport layer coating solution was coated on the charge generation layer by a Mayer bar and dried at 120° C. for 1 hour to form a charge transport layer of 24 μm in layer thickness.

An electrophotographic photosensitive member in which the charge transport layer constitutes the surface layer was thus prepared.

Evaluation processes will now be described. Sensitivities and taber abrasion amounts were evaluated.

As evaluation equipment of the sensitivity, Electrostatic Paper Analyzer EPA-8100 made by Kawaguchi Electric Works Co., Ltd. was used.

Using a corona charger, the electrophotographic photosensitive member was charged to a surface potential (dark portion potential) of −600V. Then, light having a wavelength of 400 nm, 430 nm or 450 nm was emitted (exposed) from an LED, and the light quantity necessary for reducing the surface potential to −300 V (light portion potential) was measured, and the half decay exposure sensitivity ($E_{1/2}$) was calculated at each wavelength.

The results are shown in Table 8. In table 8, the sensitivity against light having a wavelength of 400 nm is described as $E_{1/2(400)}$, the sensitivity against light having a wavelength of 430 nm was defined as $E_{1/2(430)}$, and the sensitivity against light having a wavelength of 450 nm is defined as $E_{1/2(450)}$.

As evaluation equipment of the taber abrasion amount, a rotary, taber type abrasion tester made by Yasuda-Seiki-Seisakusho, Ltd. was used. Two abrading wheels CS-0 available from Taber Instruments to which wrapping film C2000 available from FUJI PHOTO FILM CO., LTD. was applied were used, to which a load of 500 g was applied. Decrease in the mass before and after the rotary abrasion was measured and defined as the taber abrasion amount.

The results are shown in Table 9.

Examples 2-2 to 2-47, Comparative Examples 2-1 to 2-25

An electrophotographic photosensitive member in which the charge transport layer constitutes the surface layer was prepared and evaluated in the same manner as in Example 2-1 except that the binder resin of the charge transport layer in Example 2-1 was changed to those described in Tables 5 to 7. The results are shown in Tables 8 and 9.

TABLE 5

| | Binder resin of charge transport layer | | | | | | | |
|---|---|---|---|---|---|---|---|---|
| | Binder resin (A) | | | | Binder resin (B) | | | |
| | Repeating structural unit (a) | Repeating structural unit (b) | Mw | Type of polymerization | Repeating structural unit | Mw | Type of polymerization | Remarks |
| Ex. 2-1 | (1-2) | — | 150000 | Homopolymer | — | — | — | — |
| 2-2 | (1-5) | — | 150000 | Homopolymer | — | — | — | — |
| 2-3 | (1-11) | — | 100000 | Homopolymer | — | — | — | — |
| 2-4 | (1-13) | — | 180000 | Homopolymer | — | — | — | — |
| 2-5 | (1-15) | — | 120000 | Homopolymer | — | — | — | — |
| 2-6 | (1-20) | — | 200000 | Homopolymer | — | — | — | — |
| 2-7 | (1-29) | — | 150000 | Homopolymer | — | — | — | — |
| 2-8 | (1-33) | — | 100000 | Homopolymer | — | — | — | — |
| 2-9 | (1-37) | — | 90000 | Homopolymer | — | — | — | — |
| 2-10 | (1-45) | — | 130000 | Homopolymer | — | — | — | — |
| 2-11 | (1-1) | — | 115000 | Homopolymer | — | — | — | — |
| 2-12 | (1-3) | — | 125000 | Homopolymer | — | — | — | — |
| 2-13 | (1-4) | — | 140000 | Homopolymer | — | — | — | — |
| 2-14 | (1-6) | — | 160000 | Homopolymer | — | — | — | — |
| 2-15 | (1-7) | — | 100000 | Homopolymer | — | — | — | — |
| 2-16 | (1-8) | — | 120000 | Homopolymer | — | — | — | — |
| 2-17 | (1-9) | — | 160000 | Homopolymer | — | — | — | — |
| 2-18 | (1-14) | — | 110000 | Homopolymer | — | — | — | — |
| 2-19 | (1-16) | — | 170000 | Homopolymer | — | — | — | — |
| 2-20 | (1-17) | — | 200000 | Homopolymer | — | — | — | — |
| 2-21 | (1-18) | — | 150000 | Homopolymer | — | — | — | — |
| 2-22 | (1-19) | — | 165000 | Homopolymer | — | — | — | — |
| 2-23 | (1-21) | — | 140000 | Homopolymer | — | — | — | — |
| 2-24 | (1-22) | — | 140000 | Homopolymer | — | — | — | — |
| 2-25 | (1-23) | — | 100000 | Homopolymer | — | — | — | — |
| 2-26 | (1-24) | — | 100000 | Homopolymer | — | — | — | — |
| 2-27 | (1-27) | — | 150000 | Homopolymer | — | — | — | — |
| 2-28 | (1-35) | — | 120000 | Homopolymer | — | — | — | — |
| 2-29 | (1-36) | — | 170000 | Homopolymer | — | — | — | — |
| 2-30 | (1-38) | — | 155000 | Homopolymer | — | — | — | — |
| 2-31 | (1-39) | — | 135000 | Homopolymer | — | — | — | — |
| 2-32 | (1-40) | — | 250000 | Homopolymer | — | — | — | — |
| 2-33 | (1-41) | — | 170000 | Homopolymer | — | — | — | — |
| 2-34 | (1-42) | — | 110000 | Homopolymer | — | — | — | — |
| 2-35 | (1-43) | — | 140000 | Homopolymer | — | — | — | — |
| 2-36 | (1-44) | — | 135000 | Homopolymer | — | — | — | — |
| 2-37 | (1-46) | — | 120000 | Homopolymer | — | — | — | — |

TABLE 6

| | Binder resin of charge transport layer | | | | | | | |
|---|---|---|---|---|---|---|---|---|
| | Binder resin (A) | | | | Binder resin (B) | | | |
| | Repeating structural unit (a) | Repeating structural unit (b) | Mw | Type of polymerization | Repeating structural unit | Mw | Type of polymerization | Remarks |
| Ex. 2-38 | (1-5) | (1-13) | 150000 | Binary copolymer a:b = 5:5 (molar ratio) | — | — | — | — |
| 2-39 | (1-5) | (1-20) | 180000 | Binary copolymer a:b = 3:7 (molar ratio) | — | — | — | — |
| 2-40 | (1-5) | (1-40) | 125000 | Binary copolymer a:b = 5:5 (molar ratio) | — | — | — | — |
| 2-41 | (1-13) | (1-27) | 100000 | Binary copolymer a:b = 5:5 (molar ratio) | — | — | — | — |
| 2-42 | (1-13) | (1-45) | 140000 | Binary copolymer a:b = 5:5 (molar ratio) | — | — | — | — |
| 2-43 | (1-33) | (1-34) | 170000 | Binary copolymer a:b = 5:5 (molar ratio) | — | — | — | — |
| 2-44 | (1-33) | (1-40) | 100000 | Binary copolymer a:b = 5:5 (molar ratio) | — | — | — | — |

TABLE 6-continued

| | Binder resin of charge transport layer | | | | | | | |
|---|---|---|---|---|---|---|---|---|
| | Binder resin (A) | | | | Binder resin (B) | | | |
| | Repeating structural unit (a) | Repeating structural unit (b) | Mw | Type of polymerization | Repeating structural unit | Mw | Type of polymerization | Remarks |
| 2-45 | (1-40) | (1-45) | 120000 | Binary copolymer a:b = 3:7 (molar ratio) | — | — | — | — |
| 2-46 | (1-5) | — | 150000 | Homopolymer | (1-13) | 180000 | Homopolymer | Two kinds mixed A:B = 5:5 (weight ratio) |
| 2-47 | (1-33) | — | 100000 | Homopolymer | (1-34) | 125000 | Homopolymer | Two kinds mixed A:B = 5:5 (weight ratio) |

TABLE 7

| | | Binder resin of charge transport layer | | | | | | | |
|---|---|---|---|---|---|---|---|---|---|
| | | Binder resin (A) | | | | Binder resin (B) | | | |
| | | Repeating structural unit (a) | Repeating structural unit (b) | Mw | Type of polymerization | Repeating structural unit | Mw | Type of polymerization | Remarks |
| Com. | 2-1 | (1-2) | — | 60000 | Homopolymer | — | — | — | — |
| Ex. | 2-2 | (1-5) | — | 50000 | Homopolymer | — | — | — | — |
| | 2-3 | (1-11) | — | 50000 | Homopolymer | — | — | — | — |
| | 2-4 | (1-13) | — | 70000 | Homopolymer | — | — | — | — |
| | 2-5 | (1-15) | — | 60000 | Homopolymer | — | — | — | — |
| | 2-6 | (1-20) | — | 40000 | Homopolymer | — | — | — | — |
| | 2-7 | (1-29) | — | 50000 | Homopolymer | — | — | — | — |
| | 2-8 | (1-33) | — | 45000 | Homopolymer | — | — | — | — |
| | 2-9 | (1-37) | — | 50000 | Homopolymer | — | — | — | — |
| | 2-10 | (1-45) | — | 50000 | Homopolymer | — | — | — | — |
| | 2-11 | (C-1) | — | 120000 | Homopolymer | — | — | — | — |
| | 2-12 | (C-2) | — | 140000 | Homopolymer | — | — | — | — |
| | 2-13 | (C-3) | — | 130000 | Homopolymer | — | — | — | — |
| | 2-14 | (C-4) | — | 160000 | Homopolymer | — | — | — | — |
| | 2-15 | (C-5) | — | 150000 | Homopolymer | — | — | — | — |
| | 2-16 | (C-6) | — | 120000 | Homopolymer | — | — | — | — |
| | 2-17 | (C-7) | — | 180000 | Homopolymer | — | — | — | — |
| | 2-18 | (C-8) | — | 130000 | Homopolymer | — | — | — | — |
| | 2-19 | (C-9) | — | 180000 | Homopolymer | — | — | — | — |
| | 2-20 | (C-10) | — | 130000 | Homopolymer | — | — | — | — |
| | 2-21 | (C-11) | — | 130000 | Homopolymer | — | — | — | — |
| | 2-22 | (C-12) | — | 110000 | Homopolymer | — | — | — | — |
| | 2-23 | (C-13) | — | 130000 | Homopolymer | — | — | — | — |

In Table 7, (C-1) to (C-13) are as described above

TABLE 8

| | | $E_{1/2(400)}$ [μJ/cm$^2$] | $E_{1/2(430)}$ [μJ/cm$^2$] | $E_{1/2(450)}$ [μJ/cm$^2$] |
|---|---|---|---|---|
| Ex. | 2-1 | 0.53 | 0.50 | 0.48 |
| | 2-2 | 0.53 | 0.50 | 0.48 |
| | 2-3 | 0.53 | 0.50 | 0.48 |
| | 2-4 | 0.53 | 0.50 | 0.48 |
| | 2-5 | 0.53 | 0.50 | 0.48 |
| | 2-6 | 0.53 | 0.50 | 0.48 |
| | 2-7 | 0.53 | 0.50 | 0.48 |
| | 2-8 | 0.51 | 0.49 | 0.47 |
| | 2-9 | 0.51 | 0.49 | 0.47 |
| | 2-10 | 0.51 | 0.49 | 0.47 |

TABLE 8-continued

| | $E_{1/2(400)}$ [μJ/cm$^2$] | $E_{1/2(430)}$ [μJ/cm$^2$] | $E_{1/2(450)}$ [μJ/cm$^2$] |
|---|---|---|---|
| 2-11 | 0.51 | 0.49 | 0.47 |
| 2-12 | 0.51 | 0.49 | 0.47 |
| 2-13 | 0.51 | 0.49 | 0.47 |
| 2-14 | 0.51 | 0.49 | 0.47 |
| 2-15 | 0.51 | 0.49 | 0.47 |
| 2-16 | 0.53 | 0.50 | 0.48 |
| 2-17 | 0.53 | 0.50 | 0.48 |
| 2-18 | 0.53 | 0.50 | 0.48 |
| 2-19 | 0.51 | 0.49 | 0.47 |
| 2-20 | 0.51 | 0.49 | 0.47 |
| 2-21 | 0.53 | 0.50 | 0.48 |
| 2-22 | 0.53 | 0.50 | 0.48 |

TABLE 8-continued

| | | $E_{1/2(400)}$ [μJ/cm²] | $E_{1/2(430)}$ [μJ/cm²] | $E_{1/2(450)}$ [μJ/cm²] |
|---|---|---|---|---|
| | 2-23 | 0.53 | 0.50 | 0.48 |
| | 2-24 | 0.53 | 0.50 | 0.48 |
| | 2-25 | 0.53 | 0.50 | 0.48 |
| | 2-26 | 0.51 | 0.49 | 0.47 |
| | 2-27 | 0.51 | 0.49 | 0.47 |
| | 2-28 | 0.53 | 0.50 | 0.48 |
| | 2-29 | 0.53 | 0.50 | 0.48 |
| | 2-30 | 0.51 | 0.49 | 0.47 |
| | 2-31 | 0.51 | 0.49 | 0.47 |
| | 2-32 | 0.51 | 0.49 | 0.47 |
| | 2-33 | 0.51 | 0.49 | 0.47 |
| | 2-34 | 0.51 | 0.49 | 0.47 |
| | 2-35 | 0.53 | 0.50 | 0.48 |
| | 2-36 | 0.53 | 0.50 | 0.48 |
| | 2-37 | 0.53 | 0.50 | 0.48 |
| | 2-38 | 0.53 | 0.50 | 0.48 |
| | 2-39 | 0.53 | 0.50 | 0.48 |
| | 2-40 | 0.53 | 0.50 | 0.48 |
| | 2-41 | 0.53 | 0.50 | 0.48 |
| | 2-42 | 0.53 | 0.50 | 0.48 |
| | 2-43 | 0.51 | 0.49 | 0.47 |
| | 2-44 | 0.51 | 0.49 | 0.47 |
| | 2-45 | 0.51 | 0.49 | 0.47 |
| | 2-46 | 0.53 | 0.50 | 0.48 |
| | 2-47 | 0.51 | 0.49 | 0.47 |
| Com. | 2-1 | 0.53 | 0.51 | 0.49 |
| Ex. | 2-2 | 0.54 | 0.52 | 0.51 |
| | 2-3 | 0.53 | 0.51 | 0.49 |
| | 2-4 | 0.54 | 0.52 | 0.51 |
| | 2-5 | 0.53 | 0.51 | 0.49 |
| | 2-6 | 0.54 | 0.52 | 0.51 |
| | 2-7 | 0.53 | 0.51 | 0.49 |
| | 2-8 | 0.54 | 0.52 | 0.51 |
| | 2-9 | 0.53 | 0.51 | 0.49 |
| | 2-10 | 0.54 | 0.52 | 0.51 |
| | 2-11 | 0.53 | 0.51 | 0.49 |
| | 2-12 | 0.54 | 0.52 | 0.51 |
| | 2-13 | 0.53 | 0.51 | 0.49 |
| | 2-14 | 0.54 | 0.52 | 0.51 |
| | 2-15 | 0.53 | 0.51 | 0.49 |
| | 2-16 | 0.54 | 0.52 | 0.51 |
| | 2-17 | 0.53 | 0.51 | 0.49 |
| | 2-18 | 0.54 | 0.52 | 0.51 |
| | 2-19 | 0.53 | 0.51 | 0.49 |
| | 2-20 | 0.54 | 0.52 | 0.51 |
| | 2-21 | 0.53 | 0.50 | 0.48 |
| | 2-22 | Not reduced | 3.28 | 2.61 |
| | 2-23 | Not reduced | Not reduced | Not reduced |

TABLE 9

| | | Taber abrasion amount [mg] |
|---|---|---|
| Ex. | 2-1 | 2.5 |
| | 2-2 | 2.0 |
| | 2-3 | 2.4 |
| | 2-4 | 2.0 |
| | 2-5 | 2.5 |
| | 2-6 | 2.0 |
| | 2-7 | 2.4 |
| | 2-8 | 2.0 |
| | 2-9 | 2.0 |
| | 2-10 | 2.0 |
| | 2-11 | 2.5 |
| | 2-12 | 2.0 |
| | 2-13 | 2.0 |
| | 2-14 | 2.0 |
| | 2-15 | 2.0 |
| | 2-16 | 2.3 |
| | 2-17 | 2.4 |
| | 2-18 | 2.5 |
| | 2-19 | 2.0 |

TABLE 9-continued

| | | Taber abrasion amount [mg] |
|---|---|---|
| | 2-20 | 2.0 |
| | 2-21 | 2.4 |
| | 2-22 | 2.0 |
| | 2-23 | 2.3 |
| | 2-24 | 2.5 |
| | 2-25 | 2.4 |
| | 2-26 | 2.0 |
| | 2-27 | 2.0 |
| | 2-28 | 2.6 |
| | 2-29 | 2.4 |
| | 2-30 | 2.0 |
| | 2-31 | 2.0 |
| | 2-32 | 2.0 |
| | 2-33 | 2.0 |
| | 2-34 | 2.0 |
| | 2-35 | 2.3 |
| | 2-36 | 2.4 |
| | 2-37 | 2.4 |
| | 2-38 | 2.1 |
| | 2-39 | 2.0 |
| | 2-40 | 2.0 |
| | 2-41 | 2.1 |
| | 2-42 | 2.0 |
| | 2-43 | 2.0 |
| | 2-44 | 2.0 |
| | 2-45 | 2.0 |
| | 2-46 | 2.1 |
| | 2-47 | 2.0 |
| Com. | 2-1 | 5.8 |
| Ex. | 2-2 | 5.8 |
| | 2-3 | 5.8 |
| | 2-4 | 5.5 |
| | 2-5 | 5.8 |
| | 2-6 | 5.4 |
| | 2-7 | 5.9 |
| | 2-8 | 5.4 |
| | 2-9 | 5.9 |
| | 2-10 | 5.4 |
| | 2-11 | 3.6 |
| | 2-12 | 3.7 |
| | 2-13 | 3.8 |
| | 2-14 | 3.5 |
| | 2-15 | 3.9 |
| | 2-16 | 3.5 |
| | 2-17 | 3.7 |
| | 2-18 | 3.5 |
| | 2-19 | 3.9 |
| | 2-20 | 3.4 |
| | 2-21 | 6.8 |
| | 2-22 | 3.4 |
| | 2-23 | 2.7 |

This application claims priority from Japanese Patent Application No. 2004-264221 filed Sep. 10, 2004, which is hereby incorporated by reference herein.

The invention claimed is:

1. An electrophotographic apparatus comprising an electrophotographic photosensitive member, a charging means, an exposure means, a developing means, and a transferring means, wherein the exposure means is for irradiating the electrophotographic photosensitive member with light having a wavelength of 380 to 450 nm as exposure light, wherein the electrophotographic photosensitive member comprises a support, a charge generation layer provided on the support, and a charge transport layer provided on the charge generation layer, wherein the charge transport layer is a surface layer of the electrophotographic photosensitive member, and contains a binder resin and a charge transport material, wherein the charge transport material consists of a triarylamine compound, wherein the binder resin consists of an aliphatic dicarboxylic acid polyester resin having repeating structural units consisting of repeating structural units each represented by formula (1):

(1)

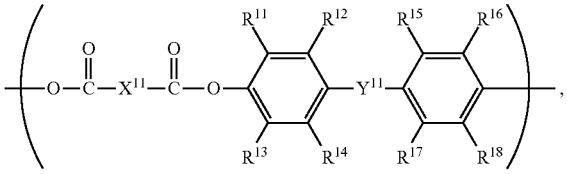

where $R^{11}$ to $R^{18}$ are each independently a hydrogen atom, a methyl group, an ethyl group or a phenyl group, $X^{11}$ is a butylene group, a pentylene group, a hexylene group, a heptylene group or an octylene group, and $Y^{11}$ is a single bond, an oxygen atom, a sulfur atom or a divalent group having a structure represented by formula (2):

(2)

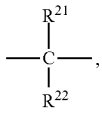

where $R^{21}$ and $R^{22}$ are each independently a methyl group, an ethyl group, a propyl group or a trifluoromethyl group, or $R^{21}$ and $R^{22}$ are bonded together to form a cyclohexylidene group, and wherein the aliphatic dicarboxylic acid polyester resin has a weight average molecular weight of 80,000 or more.

2. The electrophotographic apparatus according to claim 1, wherein the triarylamine compound is an amine compound having a structure represented by formula (CTM-2):

(CTM-2)

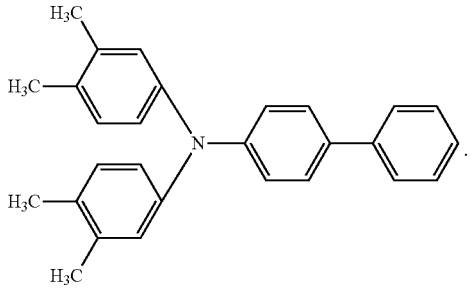

* * * * *

Disclaimer 7,927,774—Harunobu Ogak, Suntoh-gun, JP; Takakazu Tanaka, Numasu, JP; Kenichi Kaku, Suntoh-gun, JP; Akira Yoshida, Yokohama, JP. ELECTROPHOTOGRAPHIC PHOTOSENSITIVE MEMBER, PROCESS CARTRIDGE AND ELECTROPHOTOGRAPHIC APPARATUS. Patent dated April 19, 2011. Disclaimer filed Jan. 12, 2011, by the assignee, Canon Kabushiki Kaisha.

The term of this patent shall not extend beyond the expiration date of Pat. No. 7585604.

(*Official Gazette* May 24, 2011)